US009435094B2

(12) United States Patent
Collis

(10) Patent No.: US 9,435,094 B2
(45) Date of Patent: Sep. 6, 2016

(54) GROUND STABILISATION SYSTEM, A SUPPORT AND A METHOD OF STABILISING GROUND

(71) Applicant: GeoInnovations Limited, Dorset (GB)

(72) Inventor: Simon Paul Collis, Dorset (GB)

(73) Assignee: GEOINNOVATIONS LIMITED, Dorset (GB)

( * ) Notice: Subject to any disclaimer, the term of this patent is extended or adjusted under 35 U.S.C. 154(b) by 0 days.

(21) Appl. No.: 14/414,581

(22) PCT Filed: Jul. 22, 2013

(86) PCT No.: PCT/GB2013/000315
§ 371 (c)(1),
(2) Date: Jan. 13, 2015

(87) PCT Pub. No.: WO2014/013215
PCT Pub. Date: Jan. 23, 2014

(65) Prior Publication Data

US 2015/0204042 A1 Jul. 23, 2015

(30) Foreign Application Priority Data

Jul. 20, 2012 (GB) ..... 1213003.5

(51) Int. Cl.

| | |
|---|---|
| ***E02D 3/12*** | (2006.01) |
| ***E02D 27/50*** | (2006.01) |
| ***E02D 3/02*** | (2006.01) |
| ***E02D 27/00*** | (2006.01) |
| ***E02D 27/32*** | (2006.01) |
| ***E21D 20/02*** | (2006.01) |

(52) U.S. Cl.
CPC . *E02D 3/12* (2013.01); *E02D 3/02* (2013.01); *E02D 27/00* (2013.01); *E02D 27/32* (2013.01); *E02D 27/50* (2013.01); *E21D 20/021* (2013.01)

(58) Field of Classification Search
CPC ..... E02D 5/46; E02D 5/54; E02D 5/62; E02D 3/12
USPC ..... 405/229–257, 259.1, 259.5
See application file for complete search history.

(56) References Cited

U.S. PATENT DOCUMENTS

| | | | | |
|---|---|---|---|---|
| 3,636,717 A * | 1/1972 | Pogonowski | ..... | E02D 5/62 405/226 |
| 3,665,717 A * | 5/1972 | Sweeney | ..... | E02D 5/76 405/259.5 |
| 3,735,541 A * | 5/1973 | Vanderlinde | ..... | E02D 5/808 405/244 |
| 4,018,056 A * | 4/1977 | Poma | ..... | E02D 5/36 405/233 |
| 7,097,388 B1 * | 8/2006 | Mansour | ..... | E02D 35/00 405/230 |

* cited by examiner

*Primary Examiner* — Tara M. Pinnock
(74) *Attorney, Agent, or Firm* — Wenderoth, Lind & Ponack, L.L.P.

(57) ABSTRACT

The present invention relates to a ground stabilization system and a support and a method of stabilizing ground, more particularly to soil below a building or foundation of a structure. A system for soil consolidation is disclosed. It comprises: a delivery channel (10) that is closed at one end and adapted to receive a grout or resinous liquid (99). The delivery channel (10) has a plurality of apertures (20) that are selectively openable and closable, ideally by way of a concentric member (40) in order to permit filler or resinous material (99) to exude/egress from the delivery channel (10) into selected regions of surrounding soil at desired times, in a controllable manner, so as to create a stabilized volume of soil bonded to the delivery channel.

16 Claims, 16 Drawing Sheets

GROUND STABILISATION SYSTEM, A SUPPORT AND A METHOD OF STABILISING GROUND

FIELD OF INVENTION

The present invention relates to a ground stabilisation system and a support. There is also disclosed a method of stabilising ground, more particularly the soil below a building or foundation of a structure, or to retaining earth or embankment.

BACKGROUND

Ground stabilisation is a descriptive term for the enhancement of soil which, by virtue of its nature or changes to its properties, has become unstable or insufficiently strong to carry required loads or be stable. Factors which affect the stability of soil include loss of lateral support, removal of fine grains by washout from flowing water, decay of organic materials in the soil, changes in soil moisture content and progressive soil compaction over time, and/or movement of soil under pressure or down a gradient.

Conventional piles require end bearing capability or friction or both, to provide support. To achieve this, a pile must either be of a sufficiently large diameter, to provide sufficient end bearing capabilities or have a mechanically profiled surface in order to enhance its friction against the soil. In some circumstances both features are employed in a pile so as to impart the desired load bearing characteristics.

In order to drive piles with the desired load bearing capabilities, in situ, powerful and often large equipment is required to install the piles. This large equipment or heavy plant can sometimes pose serious problems in some situations, for example where access is limited or costs are prohibitive.

Also use of larger diameter piles results in the pile needing to be located farther from a centre line of a structure, such as a foundation or wall, which in turn requires that the piles themselves need to be stronger for the same application. A consequence is that the location of such large piles is not always at the desired or optimum position.

Permeation grouting is a process of improving ground stabilisation by filling interstitial gaps between particles of soil with a liquid, such as grout, cement, polyurethane or other resinous substance, that subsequently sets or cures, as a solid. The process requires that the soil be sufficiently porous to receive the resinous substance or liquid. Soils, such as fine silt and clay are termed cohesive and cannot normally be permeation grouted. However, silt and clay formations are commonly found beneath foundations of buildings, either in layers or as discrete pockets.

Such layers or pockets tend to disrupt or 'break' the continuity of a permeation grouted column, rendering all permeation grouted soil below the so-called 'break' redundant and therefore only capable of providing limited improvement in ground stability.

The present invention arose in order to overcome problems associated with existing ground stabilisation systems and to provide an improved ground stabilisation system.

PRIOR ART

EP-A-0 064 663 (Weichsel) discloses a method for stabilising unstable slopes by means of drilling a bore hole, and introducing a closed pipe with outlet valves that accept and distribute solidifying agent.

FR-A-1 593 239 (Zimmer) and ES-A-2 166 701 (Ereno) both disclose a soil consolidation system that includes the process of drilling bore holes and inserting a tube with an exterior valve arrangement.

CN-A-1 485 505 (Zhang) shows a tube for accepting an inner tube that operates with a valve system, wherein the tube wall includes one-way valves.

DE-A-3 228 198 (Schroll) refers to a method for improving toothing of a reinforced concrete pile root by use of a drill pipe which is removed after use and grout is subsequently inserted around the existing pile.

Although to some extent successful in certain applications, none of the aforementioned systems was able to consolidate soil that was interspersed with non-porous layers, such as clay or silt in an assured and controllable manner as a hammer driven system.

SUMMARY OF THE INVENTION

According to a first aspect of the present invention there is provided a ground stabilisation system, suitable for soil consolidation, including a delivery channel that is closed at one end and adapted to receive a grout or resinous material, the delivery channel having a plurality of apertures that are selectively openable and closable in order to permit, in use, the grout or resinous material to egress from the delivery channel into selected regions of surrounding soil in a controllable manner so as to create a stabilised volume of soil bonded to the delivery channel.

As the stabilised volume of soil is bonded to the delivery channel by the grout or resinous material, the resultant agglomeration (of soil and grout or resinous material), when cured, forms a structural element with the delivery channel which is adapted to remain in situ.

Preferably the delivery channel is adapted to be driven into the soil to be consolidated and remains in situ after the grout or resinous material has cured. The delivery channel is thus adapted to serve as a pile, stanchion, post or pillar, connected to, and bonded with, the agglomeration of stabilised volume soil.

Ideally a control means is provided for controlling egression of the grout or resinous material from the channel into selected regions of surrounding soil for desired durations of time.

Advantages of the invention include that the ground stabilisation system, subject of the present invention, is capable of applying a liquid grout or resinous material in a controllable manner both in a sense of rate of application of the grout or resinous material (i.e. in a controlled time) as well as in a spatial manner (i.e. at precise locations throughout the soil) from a hammer driven system.

Advantageously an internal valve system enables insertion of a delivery tube into the ground without the need for drilling into soil. This negates the need to use heavy, expensive and powerful installation equipment.

The internal valve system is automatically operated by withdraw of a concentric delivery channel within the structural delivery tube, as hereinafter described.

The advantages of the internal valve and concentric delivery tube also include that it functions if there is swarf, particles or soil penetration through the apertures. Also the design is tolerant of imperfections to the tube in terms of small changes in diameter and shape and thus greater reliability is assured.

It is appreciated that the delivery channel is driven into the soil, without requirement for a pre-drilled bore hole to be provided; such that the grout or resinous material can be delivered in the controlled manner to desired regions or volumes of soil surrounding the channel for a predefined duration of time. A particularly advantageous aspect of this is that the ground stabilisation system is suitable for use in loose soil conditions or those prone to movement, such as running sand.

The grout or resinous material may be any liquid filler that solidifies, remains water resistant, and bonds soil particles to form a continuous mass. For the avoidance of doubt, the terms grout or resinous material or resin are taken to refer to any liquid filler used in the processes herein described.

Preferably selective opening and closing of the apertures, for permitting the grout or resinous material to egress from the delivery channel, is achieved by way of predefined chambers formed in the delivery channel, each chamber having a set of one or more apertures through which grout or resinous material egresses into selected regions of surrounding soil.

Control of the amount of grout or resinous material that is forced through the, or each, aperture(s), is ideally by use of a displaceable hose or duct that passes through, and is removable from, one or more static non-return valve(s) which is/are located in the delivery channel, is/are fixed with respect thereto and is/are adapted to define separate chambers and seal one chamber from another upon removal of the displaceable hose or duct.

An advantage of having static valves in the delivery channel is that it enables the tube or duct to be selectively withdrawn The ground stabilisation system is suitable for consolidating a wide range of soil conditions and may be used to provide new foundations and/or to correct and/or to reinforce existing foundations and/or to provide a form of underpinning, anchoring or tethering.

The delivery channel may be driven into the ground at various angles, for example driven vertically, diagonally or horizontally into the ground.

In a preferred embodiment the delivery channel is formed from a strong and rigid material, such as mild steel, which is capable of withstanding multiple forces applied internally and externally to the delivery channel.

The improved strength allows the diameter of the delivery channel to be reduced and therefore the amount and size of equipment required for installation is as a consequence smaller, lighter and less expensive.

In alternative embodiments the delivery channel may include a flexible portion, such as an impervious flexible bag or non-rigid tube capable of accepting and distributing a liquid.

Advantageously more than one delivery channel is used and the outer surface of the, or each, delivery channel is shaped or textured, so as to act as friction bearing shoulders, thereby further improving strength of the ground stability systems by enhancing the connection between the grout and the delivery channel.

Shaped or textured outer surfaces adapt the delivery channel and are achieved, for example, by including a plurality of ridges or ribs. Advantageously the ridges or ribs create a surface offering purchase and thereby enable a cementitious grout or resinous material to form an improved bond with the delivery channel, which is ideally steel. A grout or resinous material that adheres to the steel delivery channel is preferably chosen. An example is a polyurethane based adhesive which bonds more strongly to steel. Optionally ribs may be reduced or absent.

In some embodiments the arrangement of any shaping or texturing on an external surface of the delivery channel is varied, depending upon whether the delivery channel is for use as an end bearing support or under a foundation or as an anchor.

Ideally the diameter of the delivery channel is less than 0.1 m and preferably the diameter is less than 0.05 m. An advantage of the reduced diameter of the delivery channel is that it is readily inserted in a location closer to the centre line of a structure to be supported or underpinned, such as a foundation, and therefore the pile that is formed and the agglomeration of resinous material or grout that cures, is positioned closer to an optimum load bearing location.

When inserting the delivery channel into an existing solid structure, such as for example through part of a solid foundation of a building, a so-called entry point for the delivery channel is pre-drilled and the delivery channel is then driven into the desired depth. This process has tended to compact the soil and form an intimate seal between soil and delivery channel. Previously this compaction of soil has tended to reduce the opportunity for liquid to follow a vertical path between an outside wall of the delivery channel and the ground.

By encouraging permeation of grout or resinous material in a horizontal plane, a more favourable anchoring system is formed. An advantage of this is that the requirement that the channel be encapsulated to prevent vertical leakage of grout or resin to the surface is negated.

The delivery channel may be bonded to the pre-drilled entry point so as to further enhance stability. Bonding of the delivery channel to the pre-drilled entry point tends to limit movement of the channel when in situ and prevent vertical leakage of grout or resin to the surface.

If a particularly long delivery channel is required, separate channels may be connected one to another. This may be achieved by screwing them together by way of a threaded end portion or by an interconnect, which interconnect may or may not be threaded.

The delivery channel is ideally formed from multiple interlocking sections so as to be easily transportable and so as to be adapted to any depth, typically from 1 m to 10 m. Ideally the interlocking sections have straight connectors or couplings capable of withstanding high impact when vertically loaded whilst being driven into the ground.

In a particularly preferred embodiment the delivery channel is sacrificial—that is it remains in situ—so as to provide improved stability to the ground, in particular to a region where the grout or resin is unable to penetrate the surrounding soil, for example in clay or silt regions. This prevents the occurrence of discontinuities/breaks in stabilisation structures, as the channel defines a continuous support member between regions of cured grout or resin.

In especially preferred embodiments the apertures on the delivery channel are selectively openable and closable, for example by local actuators or by way of a second delivery channel, which may be a concentric member, that is displaceable with respect to the first delivery channel so as to permit liquid to exude into the soil from the chambers formed within the delivery channel.

Ideally the selective opening and closing of apertures is achieved by way of a pair of nested delivery channels, the inner delivery channel herein referred to as the concentric member, defining a contiguous axial column within the channel and being withdrawn, from a lower position to a top position so as to reveal selective regions of apertures at desired times.

The second delivery channel fits within the main (external) delivery channel and has slots and/or apertures formed therein. Prior knowledge of the location of these slots and apertures, and their location with respect to the apertures in the external delivery channel, enable an operator to orient the slots and apertures in the internal delivery channels so as to deliver grout or resinous liquid to precise locations in the soil to be consolidated.

Typically the concentric member facilitates the flow of grout or resinous liquid from an external source, such as a remote reservoir, to the first channel. The liquid is delivered under pressure by means of a pump so as to force the grout or resinous liquid into any interstitial spaces in the soil.

The pressurised liquid can be varied in composition and quantity to provide enhancements to load bearing capacity, durability and strength, or to accommodate varying types of ground and applications. Typically load bearing capacity is enhanced by use of greater amounts of grout or resinous liquid.

A sensing means is optionally provided to detect variations in pressure and to correlate this with a pump, so as to increase or reduce pressure in dependence upon the nature of the soil into which the liquid is being pumped. So for example, if a low pressure in grout or resinous liquid is sensed, this is likely to indicate the presence of a void or porous material, so pump pressure is increased in order to deliver more grout or resinous liquid, until either back pressure increases (so indicating the void has been filled) or until a predetermined maximum volume of grout or resinous liquid has been pumped.

It is envisaged that the liquids used may include Newtonian and particulate grouts, such as polyurethane and acrylic resins, sodium silicates, cement and pulverised fuel ash (PFA) grouts. However, other grout or resinous liquids may be used that become available and meet the demands of local environments and legislation.

Typically the grout or resinous liquids become solid after a predetermined period of curing time, typically from around 3 hours or more. Some grout or resinous liquids may expand during the solidification process further increasing the permeation in the region and reducing the chances of unfilled spaces or voids.

In particularly preferred embodiments the wall of the delivery channel includes a plurality of apertures whose sizes may vary. The apertures are sized so as to allow the flow of pressurised liquid from a remote reservoir, through the concentric member to the delivery channel to the surrounding areas filling any interstitial spaces, thus permeating the surrounding ground.

It is also envisaged that apertures may be regularly spaced so as to provide even permeation into the surrounding region. In another embodiment the apertures may be positioned randomly or specifically positioned to match the ground structure, if known. For example an increased number of apertures may be present in a seam of ground that is less dense, such as gravel, whereas fewer or no apertures may be present where there is a seam of clay which is impenetrable. Such preformed apertures require prior knowledge of the soil which data may have been obtained from a previously performed survey or core sample.

Preferably the size of the apertures is dependent on the type of liquid grout being used. Most preferably when using fine substrate or grout or resinous liquids, the apertures are 4 mm diameter so as to provide good flow and reduce the risk of apertures clogging.

It is envisaged that diameters of apertures may be altered to accept alternative liquids, for example courser liquid may require larger apertures. Recessed inserts may be provided for this purpose; the insert being in the form of a frusto-conical grommet, with a variable internal bore, that is fitted to a standard recess in the internal surface of the delivery channel.

Ideally the number of apertures provided is proportional to the diameter of the delivery channel.

In other embodiments the apertures may be tapered or rifled so as to reduce the chances of a blockage whilst liquid is flowing.

Advantageously the apertures sit flush to the external surface of the delivery channel so as not to present raised openings, thereby providing a smooth outer wall to the delivery channel and reduce the friction coefficient of the delivery channel when driven into the soil. In this way the delivery channel can be readily driven into the ground with minimal risk of damage to the apertures. Any external concentric member may be readily added and removed without restriction so as to protect the external surface of the delivery channel.

Optionally covers are applied to the orifices of the apertures so as to maintain the orifices free of grit and prevent ingress of debris which might cause a blockage as the delivery channel is driven into the ground. These covers may be wax or soft plastics materials.

Preferably the closed end of the delivery channel includes a tip, typically located at the distal end of the delivery channel, which allows the delivery channel to be driven into the ground. This reduces the associated problems of drilling whereby soil collapse due to the mechanism of drilling may occur.

Ideally the tip of the delivery is shaped to form a point so as to be able to more easily penetrate the ground. The tip may be formed from a harder material so as to protect the delivery channel. An example of such a material is hardened steel or tungsten carbide.

Preferably the tip is a modular part that is accepted by the delivery channel in order to from a closed end. It is envisaged that the tip may be removably connected by screw, twist, clip or push fitting so as to form a strong connection.

Alternatively the driving tip may be permanently attached to the delivery channel for example by means of a weld.

In another preferred embodiment the delivery channel is driven into the ground by means of a vertically applied force. This method ensures improved soil compression around the delivery channel compared to drilling processes. Using a driving method over drilling also reduces the space required above ground as the apparatus requires substantially less space to operate.

In yet a further arrangement the delivery channel may be drilled into the ground. It is envisaged that the tip and any interlocking parts of the delivery channel be adapted to be threaded in order to facilitate drilling.

Optionally the delivery channel is separated into chambers by means of one or more non-return valves within the channel that limits the flow of filler/resin. The non-return valves may be evenly spaced at predetermined intervals.

Non-return valves are ideally formed by arranging a narrowing annulus within the delivery tube and positioning a concentric member (delivery tube or duct) therethrough in a sufficiently tight fit so as to prevent inadvertent backflow. Upon removal of the concentric member, a resiliently deformable flap (normally held open by the concentric member), is arranged to spring back and shut the narrowing annulus, thereby closing the valve.

Most preferably the valves may be positioned to match changes in the ground formation, subject to information provided by surveys, for example the valves may be positioned where there is loose ground such as sand or gravel; whereas no valves are located where the channels sits in denser (clay) soils.

Advantageously the delivery channel may be positioned in loose ground such as running sand, for example below the water table. Typically a conventional pile is not suitable for use in loose ground as there is a requirement for a hole to be drilled first. Often these pre-drilled holes collapsed due to the loose ground therefore inhibiting formation of an effective pile. Instead the delivery channel may be driven into the ground with no requirement for a pre-drilled hole, for example being driven through running sand and grout or resin then exuded to create a structural support in the form of the pile. As the delivery channel is sacrificial, the pile which is formed also has a known structural value related to the delivery channel used.

Furthermore the delivery channel may be suitable for providing an anchor below water, for example a subsea mooring wherein the delivery channel is driven into loose ground such as running sand on the sea bed. Advantageously the apertures may be positioned to reflect soil formations of the sea bed and grout may be selectively pumped to create greater permeation at the distal tip of the delivery channel to aid systems where the pile functions under tension as opposed to compression. This improves stability, in particular where for example the substrate may be changeable, such as the sea bed.

Preferably the delivery channel is adapted for use in running sand or a similar loose ground to include external ribs that provide increased purchase for the grout to bond with the delivery channel. Typically the ribs are arranged to allow the pile to be readily driven into the ground.

Ideally apertures are provided between the ribs to allow grout or resin to be exuded and to ensure the portions between the ribs becomes filled with the resultant cured or solidifying material.

In a preferred embodiment the distal tip may house a cable which runs to the proximal end of the delivery channel that serves to provide a tether, for example for use as part of a mooring system. Typically the tether is secured distally to bear maximal weight and becomes set in the grout or resin forming a core within the pile formed from the delivery channel and cured grout or resinous liquid.

In another embodiment the proximal end of the delivery channel may be threaded so as to accept an end cap which includes a tether so as to allow an object to be connected to the tether which is secured to the ground by means of the permeation pile or to seal against loss of liquid or to act as a restraint.

Preferably the (or each) valve(s) is/are openable and closeable by insertion and retraction of the concentric member, although other remote valve opening techniques are envisaged. The valve(s) control(s) the flow of liquid into or out of the chamber.

In a further embodiment, one more valves may be positioned at the chamber entrance, or exit, to control the flow of liquid in two directions. Valve(s) may act to prevent the flow of liquid into the chamber, from an adjacent chamber below, as well as into the chamber, from an adjacent chamber above.

In preferred embodiments an upper most valve is configured to control flow into and out of the chamber so as to prevent pressurised liquid from being injected into lower soil levels, and restricted to the top chamber to enable controlled augmentation of the upper soil region. This is advantageous as it enables a greater bearing area under a foundation, for example.

In yet a further embodiment a distal end of the (internal) concentric member may include a valve and optionally a seal. This is advantageous as it enables a greater bearing area at the end of the pile (end bearing).

According to a second aspect of the present invention there is provided a method for soil consolidation comprising the steps of: providing a delivery channel that is adapted to receive grout or resinous liquid under pressure; driving the delivery channel into ground to be consolidated; and urging grout or resinous liquid through selected apertures in the delivery channel in order to permit the grout or resin to egress from the delivery channel into selected regions of surrounding soil for desired durations of time.

Other preferred aspects of the invention, described above with reference to the system, may be incorporated into the method as appropriate.

According to another aspect of the invention there is provided a method of fabricating a delivery channel comprising the steps of: introducing one or more one way valves into a hollow channel at predefined locations, so as to define chambers, and fixing the valves with respect to the internal wall of the delivery channel by way of a connection.

Ideally a V-shaped form or bevelled mouth is provided to receive the concentric member. This V-shaped form or bevelled mouth is preferably provided in the one way valves and acts to guide the concentric member or delivery tube through the valve prior to use.

Insertion of the concentric member or delivery is ideally carried out using a stiff former or locating rod with an optional dome to centre the concentric member or delivery tube or duct. An advantage of this is that the concentric member or delivery tube or duct can be inserted on site and after the delivery channel has been driven into the ground close to a structure to be supported.

Other applications of the invention include use as an anchor or as part of a tethering system; integration in a building, use to underpin or support floors, as a foundation or as an integral part of a structure, for example in regions prone to earthquakes, as a support for subsoil consolidation.

Preferred embodiments of the invention will now be described, by way of example only, and with reference to the Figures, in which:

DETAILED DESCRIPTION OF PREFERRED EMBODIMENTS OF THE INVENTION

Figure 1:
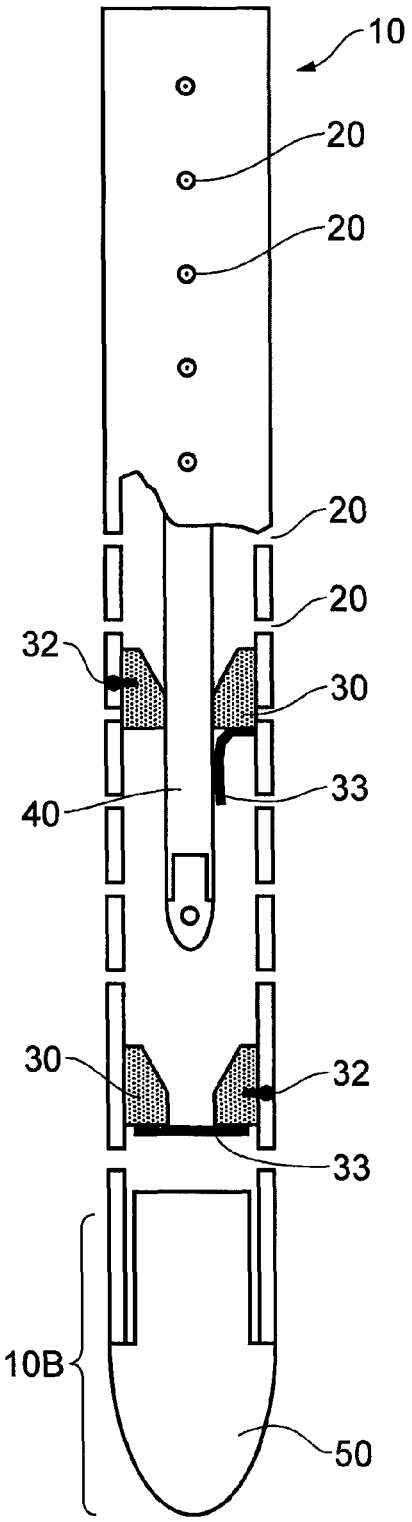
FIG. 1 shows a partial cross section of an end portion of one embodiment of a delivery channel and a concentric member.

Referring to the Figures generally, and in particularly FIG. 1, there is shown a delivery channel 10 suitable for use with a ground stabilisation system 500 (shown schematically in FIG. 1A) to consolidate soil. The delivery channel 10 has an open end 12 and a tip 50 at is closed end. Delivery channel 10 is adapted to receive a liquid, such as grout, resin or a similar material 99, from a reservoir 170, through its open end 10A via concentric member 40. A sensor 502 feeds back a signal to a pump 160 which increases or decreases pressure of the grout or filler.

Delivery channel 10 has a plurality of apertures 20 that are selectively openable (upon insertion of the concentric member 40) and closable (upon withdrawal of the concentric member 40), in order to permit, in use, the grout or resinous material 99 to egress from the delivery channel 10 into selected regions of surrounding soil, as shown in FIGS. 3 to 6. Grout or resinous material 99 is delivered in a controllable manner by way of pump 160 under control of sensor 502 (FIG. 1A) so as to create a stabilised volume of soil when the grout or resinous material 99 cures to form a solid mass.

The delivery channel 10 is typically formed from mild steel, of an approximate thickness of between 2 mm to 15 mm and diameter of between 25-100 mm. Delivery channel 10 is shown in operation, in greater detail, in FIG. 10 which illustrates the paths taken by liquid resinous material 99 as it disperses through apertures 20 into non-cohesive soil, such as sand 104, so as to create a stabilised volume of soil 105.

Figure 4:
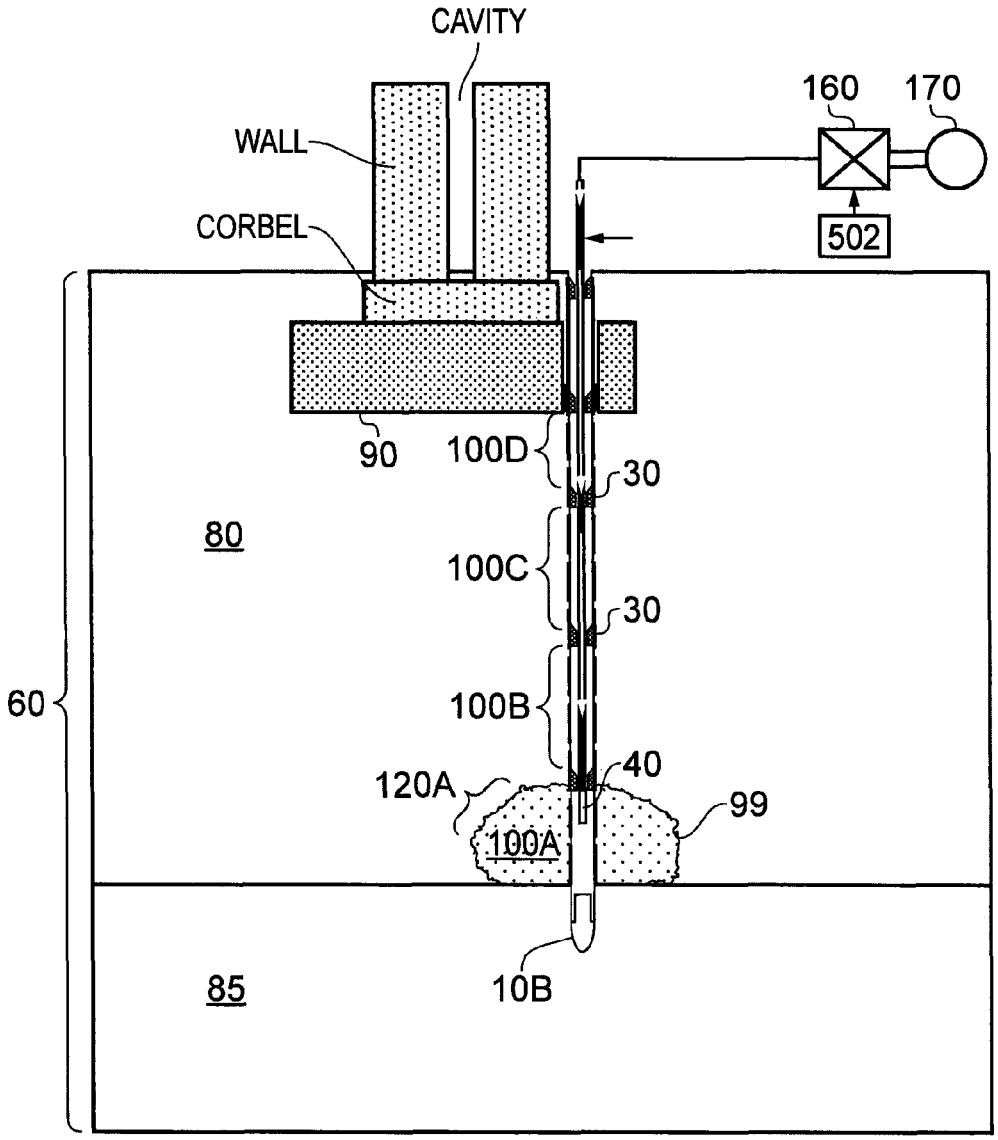
FIG. 4 shows a schematic cross section of the support in use with one chamber filled and surrounding ground permeated.

FIG. 4 shows key features of one embodiment of a system 500 for soil consolidation. The system 500 includes a delivery channel 10 which in use is closed by a tip 50 at its distal end 10B. A sensing means 502 is provided to detect internal pressure within delivery channel 10.

Delivery channel 10 has a plurality of apertures 20, typically exposed along its length in rows, although the apertures 20 may be positioned in zones or spirals or any other pattern. Ideally apertures are located circumferentially on the delivery channel; arranged in sets spaced equidistant in the same plane. Typically sets of apertures are spaced apart by between 50 mm and 500 mm, more preferably between 100 mm and 300 mm.

Figure 5:
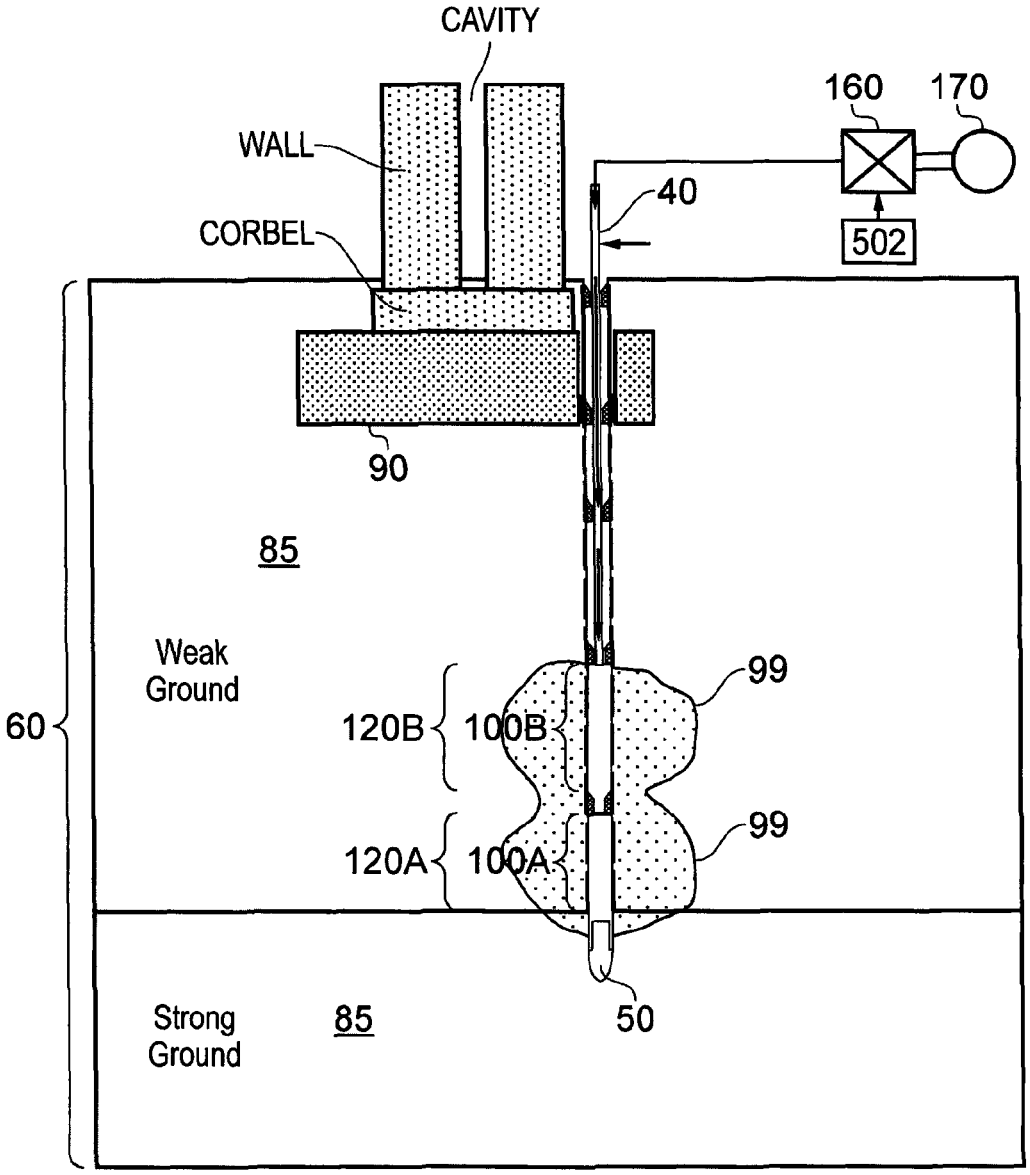
FIG. 5 shows a schematic cross section of the support in use with two chambers filled and two surrounding areas of ground permeated.
Figure 6:
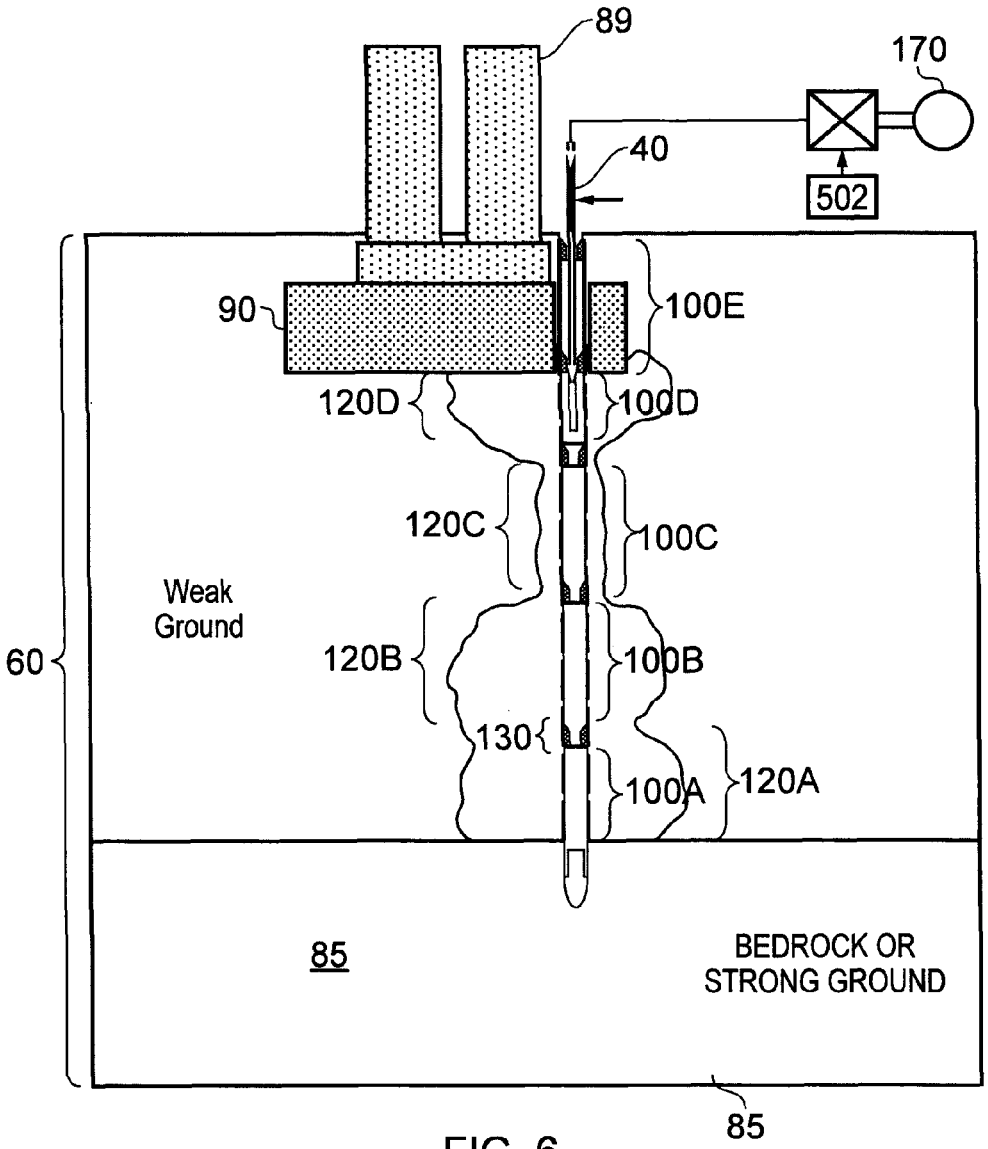
FIG. 6 shows a schematic cross section of the support in use with all sub foundation chambers filled and surrounding ground permeated.

The apertures 20 are selectively openable and closable in order to permit, in use, the filler/resin to exude/egress from the channel 10 into selected regions of surrounding soil 60 at desired times. This process is depicted diagrammatically in FIGS. 3 to 6 which show sequentially the process of: driving the delivery channel 10 into the soil (FIG. 3); and then introducing grout or resinous material flows into each chamber, commencing from the distal chamber 100A at the tip region of the delivery channel (FIG. 4); closing the distal chamber 100A; opening a second chamber to receive the grout or resinous material; and forcing grout or resinous material into a different region of soil (FIGS. 5 and 6).

Referring to this processing in greater detail: FIG. 4 shows the concentric member 40 positioned in the distal chamber 100A therefore making the corresponding apertures open while those in all above chambers, 100B, 100C, 100D, 100E are closed. Alternatively the delivery channel 10 is inserted through a concrete foundation 90, through a pre-drilled hole, into weak ground 80. In the shown embodiment the delivery channel 10 has been driven into the weak ground 80 until securing a bearing on strong ground 85.

The ground stabilisation system delivery channel 10 is typically inserted into a pre-drilled hole in the foundation 90 under a building and then driven into the soil 60 by application of a vertical force such as a mechanical hammering system.

The delivery channel 10 receives liquid from a concentric member 40 that is fed from a remote reservoir 170 that stores the grout or resin in liquid form. The ground stabilisation system includes a mechanism such as a pump 160 to pass pressurised liquid from a remote reservoir 170 to the delivery channel 10 that is positioned in the ground 60.

Figure 1A:
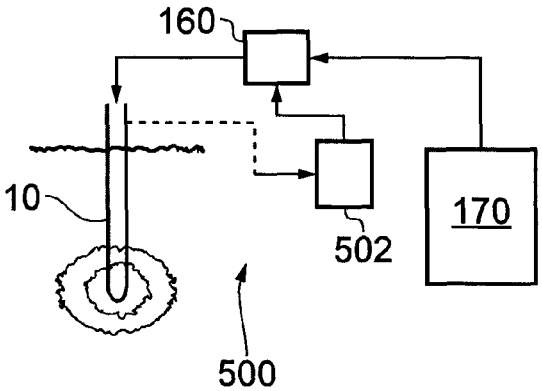
FIG. 1A shows a diagrammatic view of a ground stabilisation system that is used to controllably deliver grout or resinous liquid.

Referring now to FIG. 1A, which shows a diagrammatic view of a ground stabilisation system, pump 160 pumps grout or resinous material 99, from a reservoir 170 into a tube or hose, hereinafter referred to as the concentric member 40, into selected chambers of the delivery channel 10, under control of a sensor 502, in order to controllably deliver grout or resinous liquid to desired regions of soil to be stabilised. Sensor 502 may detect pressure changes and/or absolute pressure and/or mass flow and/or load on pump 160.

Referring now to FIGS. 5 and 6, which show cross sections of the ground stabilisation system with sequential permeation of weak ground.

The delivery channel 10 comprises a plurality of chambers 100 separated by non-return valves 30 which prevent/limit backflow and/or through flow. The liquid is pumped into a chamber 100 and once the chamber 100 is filled and pumping is continued the chamber becomes pressurised thus forcing the liquid to be exuded through the apertures 20 into the weak ground 80 to form a lobe 120 that serves as a ground anchor 200.

In FIGS. 4 to 6, the delivery channel 10 is shown in situ with the concentric member 40 positioned in the distal chamber 100A. Each chamber 100 is defined by a valve 30 that prevents/limits the flow of liquid. In FIG. 4 the grout or resinous liquid has been pumped only into the distal chamber 100A. As the chamber has filled it has become pressurised and the liquid has therefore been exuded through the apertures 20 to permeate the soil immediately surrounding chamber 100A to create lobe 120A.

FIG. 5 shows a second phase of the sequential filling of the delivery channel 10 in which second chamber 100B has been filled with grout or resinous material delivered by the concentric member 40.

The concentric member 40 is retracted from its position in FIG. 4 to the second chamber 100B so as to selectively open the apertures 20 in chamber 100B so as to allow the permeation of the surrounding soil 85 via the apertures 20 creating a second lobe 120B of what eventually becomes a solid and continuous subterranean structure or pile. All other apertures 20 in chambers other than 100B are closed. This is due to the effect of removing the concentric member 40 through the non-return valve which isolates the chamber 100B from chamber 100A as described below. Chamber 100C remains isolated due to the nature of the fit between concentric member 40 and the non-return valve between chambers 100B and 100C and the fact that the grout or resinous material 99 is pumped under relatively low pressures, thereby minimising any back flow "up" the delivery channel 10.

FIG. 6 shows the completed sequential filling of the delivery channel 10 below the foundation 90 wherein there is shown permeation of the ground 60 surrounding chambers 100A, 100B, 100C, 100D thereby creating a continuous zone or mass of material which is bonded together when the grout or resinous material 99 cures, so as to form a solid weight bearing mass or pile.

The release of grout from the apertures 20 to the surrounding ground by the sequential opening and closing of the apertures 20 has resulted in the formation of multiple lobes 120A, 120B, 120C, 120D along the external length of the delivery channel 10. The multiple lobes 120 serve as anchors (for example as in FIGS. 6, 7A and 7B) in the soil enhancing stabilisation.

Lobe 100C shows a reduced grout penetration of the soil 80 and therefore a smaller lobe 120 indicating cohesive ground.

In other embodiments the delivery channel 10, or more particularly the chamber 100 that is in a region of cohesive ground that cannot be permeated such as clay or silt, may not include any apertures 20.

For improved stability the void 140 between the delivery channel 10 and the wall of the pre-drilled hole in the foundation 90 as shown in FIGS. 3 to 6 is preferably bonded. The foundation may be bonded to the delivery channel by means of a sleeve or bonding adhesive. The void 140 may also include a foundation gasket 150 as shown in FIG. 3-6 to form a seal between the delivery channel and the walls of the pre-drilled hole so as to prevent leakage of liquid.

As mentioned above, pump 160 is positioned above ground and forces liquid (resin or grout 99) from the reservoir 170 to the delivery channel 10 via the concentric member 40. The delivery channel 10 has a number of apertures 20 through which the pressurised liquid, when received, can flow out into the surrounding soil 60. The portion of the delivery chamber 10 immediately around the valve 30 referred to hereinafter as cuff 130 is shown in FIG. 6. The cuff 130 does not have any apertures formed therein, so as to provide a region that is not permeated by the liquid or resinous grout 99. The cuff 130 therefore enables the formation of a lobe 120 as opposed to a continuous concentric layer around the chambers 100. The variation of size and location of the cuff may be chosen in order to suit variations in soil type so as to optimise usage of liquid or resinous grout 99.

FIG. 6 also shows a double valve 30 in upper chamber 100D wherein the flow of liquid 99, through the delivery channel 10, may be limited in both directions. Valve 30A operates to prevent backflow and upper valve 30B prevents/limits flow into chamber 100C so as to prevent liquid being inadvertently forced into an adjacent chamber. This arrangement of valves 30, the concentric member 40 and closure flaps 33 enables selective and controlled permeation of liquid or resinous grout 99 in specified regions; in this case the region immediately under the foundation 90. It will be appreciated that other types of internal concentric valve systems may be used according to specified requirements, budgets and pressure ranges.

Referring now in detail to the structure of the delivery channel 10, FIG. 1 shows a partial cross section of a preferred embodiment of the delivery channel 10 fitted with a plurality apertures 20 at irregular intervals. In some circumstances apertures may be formed at different intervals, where detailed knowledge of the soil is known. For example if the delivery channel is being used in a soil where there is a band of clay 0.5 m thick, then bespoke delivery channels could be formed which do not have any apertures in this region of clay, when the delivery channels are sunk to a predetermined depth. FIG. 1 also reveals a tip 50 that is a solid rounded structure typically formed of metal. The tip serves to guide the delivery channel 10 into the ground 60 and may be formed from a hardened substance such as tungsten carbide.

The apertures 20 are drilled through the delivery channel 10 so as to allow liquid, typically grout, pumped into the delivery channel 10 to be expelled through the apertures 20 into the ground 60, filling the interstitial spaces in the ground in a process referred to hereon in as permeation grouting.

FIG. 1 also shows a bulkhead valve 30 mounted on the internal face of the delivery channel 10 to prevent the back flow of liquid in the delivery channel 10. The valves 30 are fitted to the delivery channel 10 by way of at least one grub screw 32 that passes through the wall of the delivery channel 10 and locks the valve 30 in position. Grub screws 32 fit into a countersunk recess so that they lie flush with the outer surface of delivery channel 10.

Figure 10:
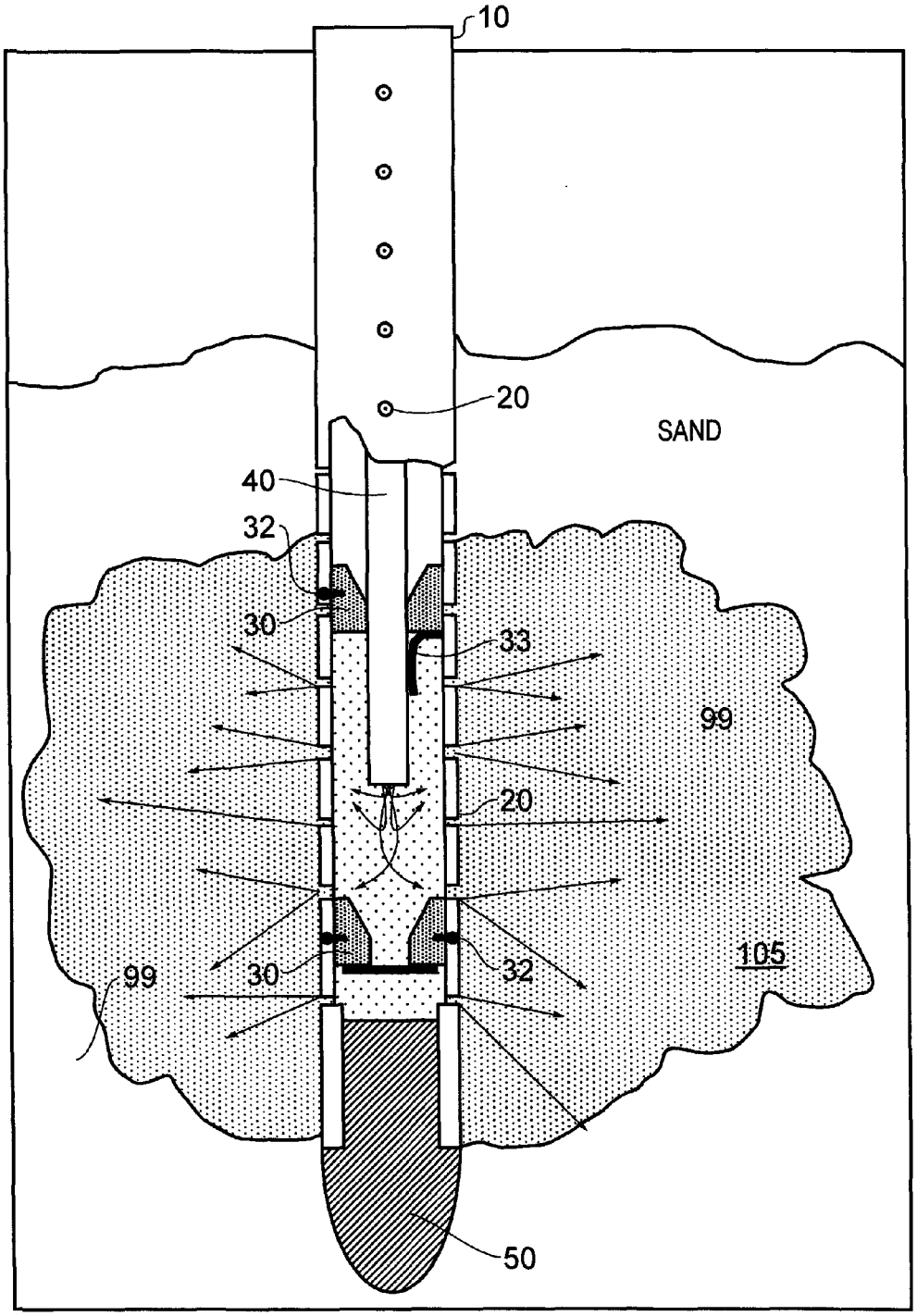
FIG. 10 is a schematic cross section of a delivery channel showing resin dispersing into non-cohesive soil to be consolidated.

Referring briefly to FIGS. 1 and 10, the valves 30 include a flap 33 which is dimensioned and arranged to close upon withdrawal of concentric member 40 which acts as a delivery duct or tube for the grout or resinous material. One valve 30 is open, 30A; the other valve is closed 30B. The internal housing of the valves 30 enables the delivery channel 10 to be driven or drilled into position.

The concentric member 40 supplies the grout to the chamber by means of a pump 160 under control of an operator or a drive system under control of a sensor 502. In addition to varying pressure of grout or resinous liquid, the control system may be arranged to control which chamber receives the pressurised grout or resinous liquid and the duration of time that grout or resinous liquid is supplied to a chamber.

The insertion of concentric member 40 also opens valve 30 and when removed causes the valve 30 to close. This formation of chambers, defined by valves 30, enables the distribution of grout to be controlled; thereby ensuring that at every distance from the tip of the delivery channel 10 permeation grouting is carried out for the desired duration, if viable, and without undue waste.

The aforementioned method of sequentially filling chambers of the delivery channel 10, from the bottom upwards, has been found to provide superior quantifiable support, as verified in Table 1 which shows test results from multiple samples of soil permeation grouted with geotechnical grade polyurethane resin.

Table 1 is in 3 sections. The first section tabulates results from a sample made in 100 mm×100 mm cube moulds, the second section shows results from a larger 150×150 mm cube moulds and the third section shows results from 102 mm cores made from actual permeation grouted ground. The samples were made to validate the design assumptions allowed when using the composite permeation piles for underpinning.

Permeation grouting requires that the soil to which the grout or resinous material is to be applied is sufficiently porous to receive grout. Soils, such as fine silt and clay are termed cohesive and cannot be permeation grouted. Such Layers of silt and clay are commonly found beneath foundations either in layers or discrete pockets and as permeation grouting is not viable the filled delivery channel 10 provides structural support in its absence.

If using only permeation grouting without the addition of the delivery channel that remains in situ the cohesive pockets break the continuity of the permeation thus rendering permeation grouted soil below the break redundant. The addition of the sacrificial delivery channel 10 provides continuity of sub soil stability despite breaks in the soil, such as a cohesive seam of soil, thus providing a strong structural element.

Some piling systems may rely on an end bearing that requires a large diameter to provide sufficient end bearing, or friction bearing that requires a mechanically profiled surface to enhance friction against the soil. Both systems may require large installation equipment thus limiting viability in some locations.

As the delivery channel 10 is a structural element in isolation it can be smaller than conventional systems thus enabling it to be placed in smaller spaces. Delivery channel 10 provides a delivery channel for permeation grouting which is carried out subsequent to placement.

Use of a smaller diameter of delivery channel 10 enables the support to be positioned closer to the centre line of the structure, for example closer to the supporting wall, as shown in FIGS. 3 to 6, in the case of a building. Whereas a larger support, such as a conventional pile was previously located further from the centre line of the structure, due to, amongst other things, as the size of the equipment required to drill or drive piles.

The process of permeation grouting through the delivery channel 10 effectively increases the diameter in situ providing a high friction support with an enhanced end bearing provided by the permeation grouted mass surrounding the tip 50.

Figure 2:
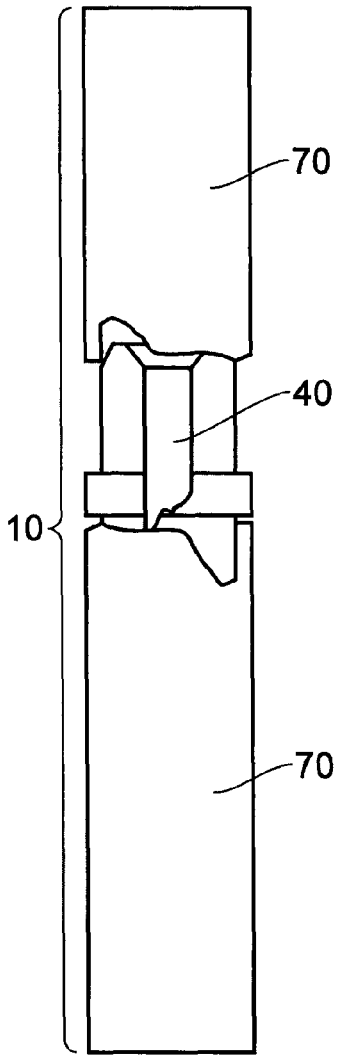
FIG. 2 shows a cutaway view of one example of a coupling for connecting one delivery channel to another.

FIG. 2 is an overview of one example of a coupling connecting one part of the delivery channel to another showing an example of a coupling mechanism by which two shafts 70 of delivery channel 10 can be joined together. Therefore enabling the delivery channel 10 to be transported and prepared in smaller sections that can be assembled on site.

Figure 3:
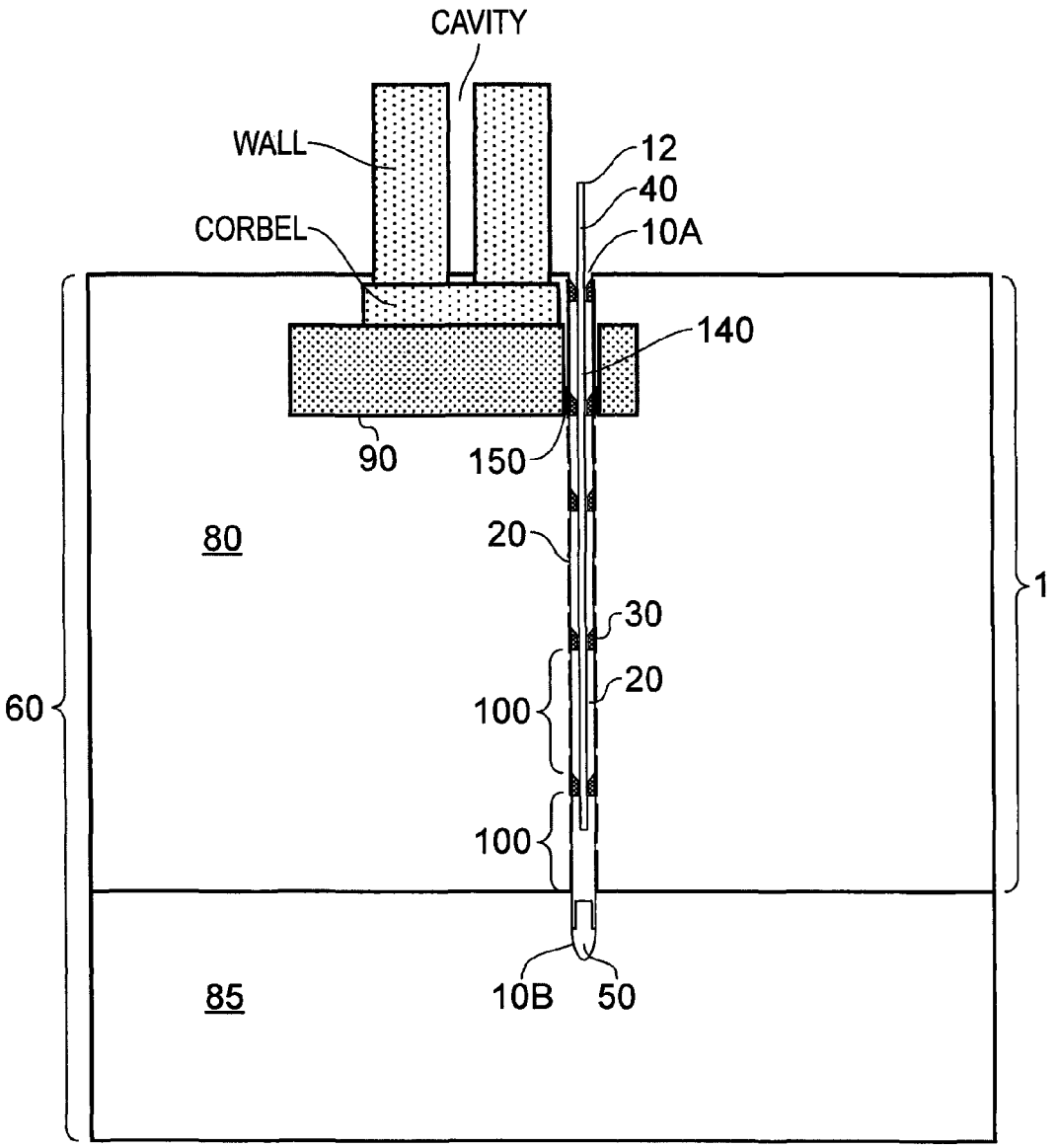
FIG. 3 shows a schematic cross section of the delivery channel shown in FIG. 1 and indicates an internal non-rigid tube through which grout or resinous material flows into each chamber.

FIG. 3 shows a schematic cross section of the channels used as a support in situ. FIG. 3 shows the parts of a delivery channel 10, with 5 chambers, 100A, 100B, 100C, 100D, 100E and the concentric member 40 when in situ through a foundation 90 wherein no permeation of the soil 60 has occurred. The concentric member 40 is shown inserted to the distal most chamber of the delivery channel 10 whereby sequential filling typically begins.

Figure 7A:
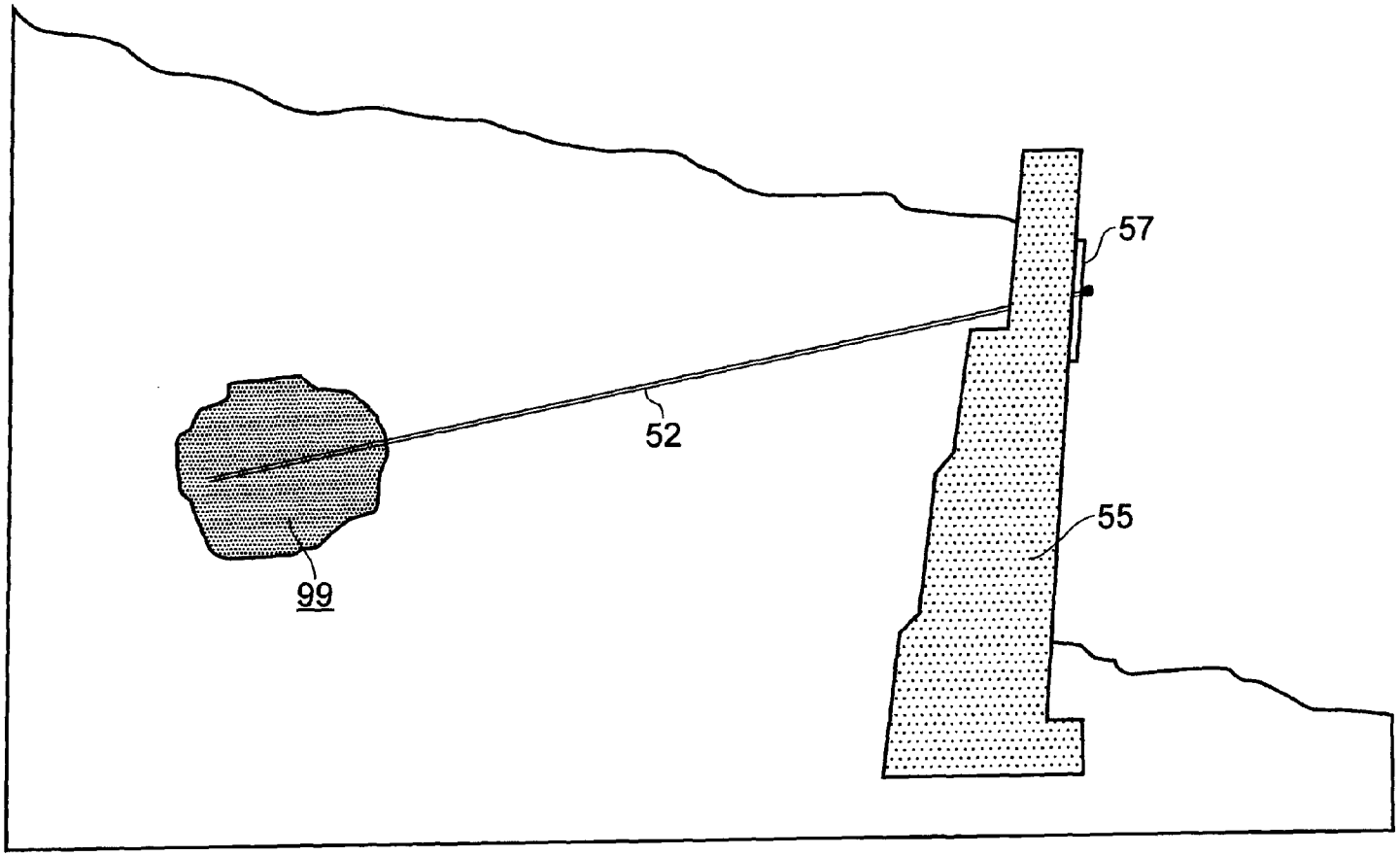
FIG. 7A shows a cross section of a delivery channel for use as an anchor or end bearing.
Figure 7B:
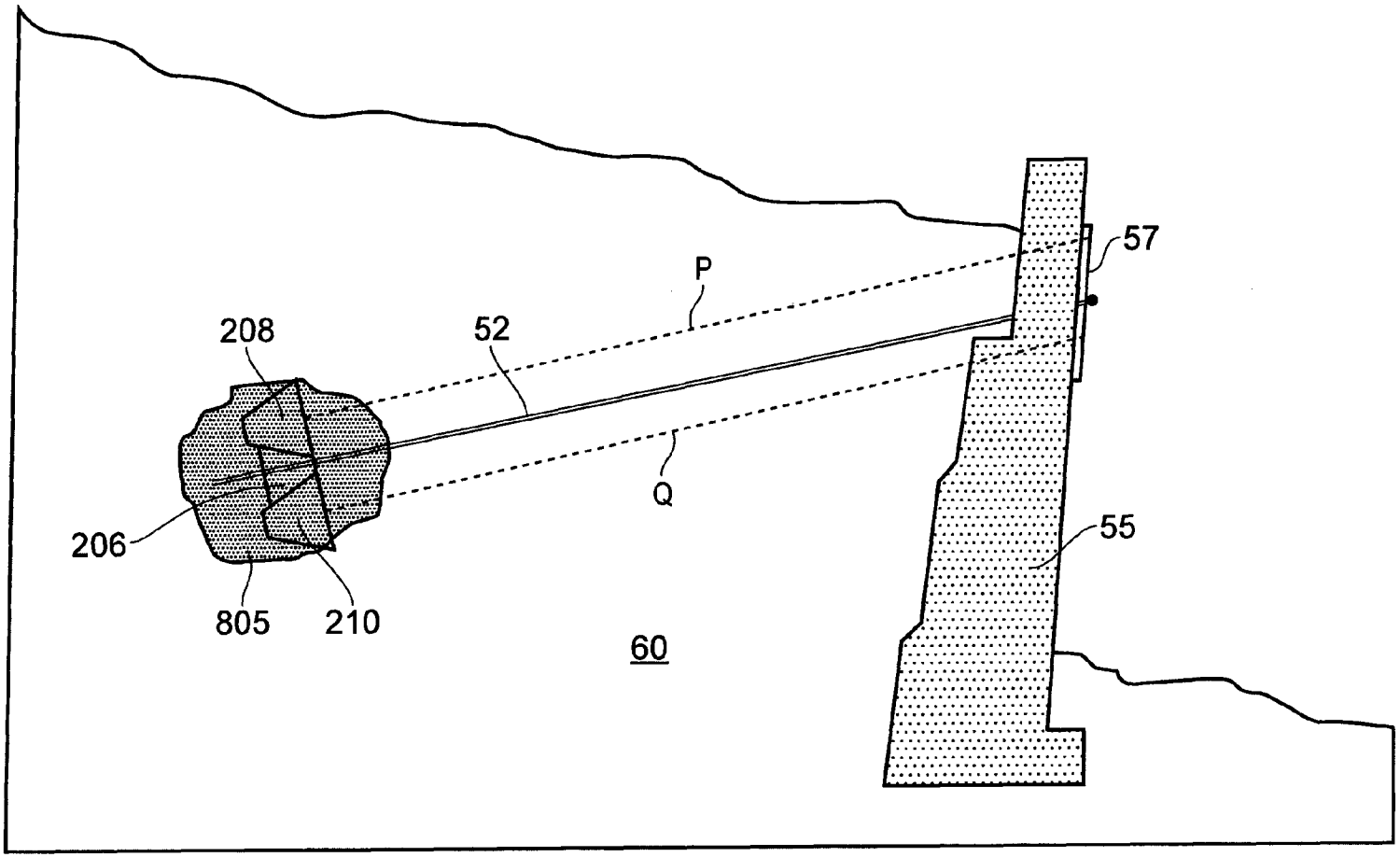
FIG. 7B shows a cross section of a delivery channel for use as an anchor which incorporates the arrangement shown in detail in FIG. 14.
Figure 8:
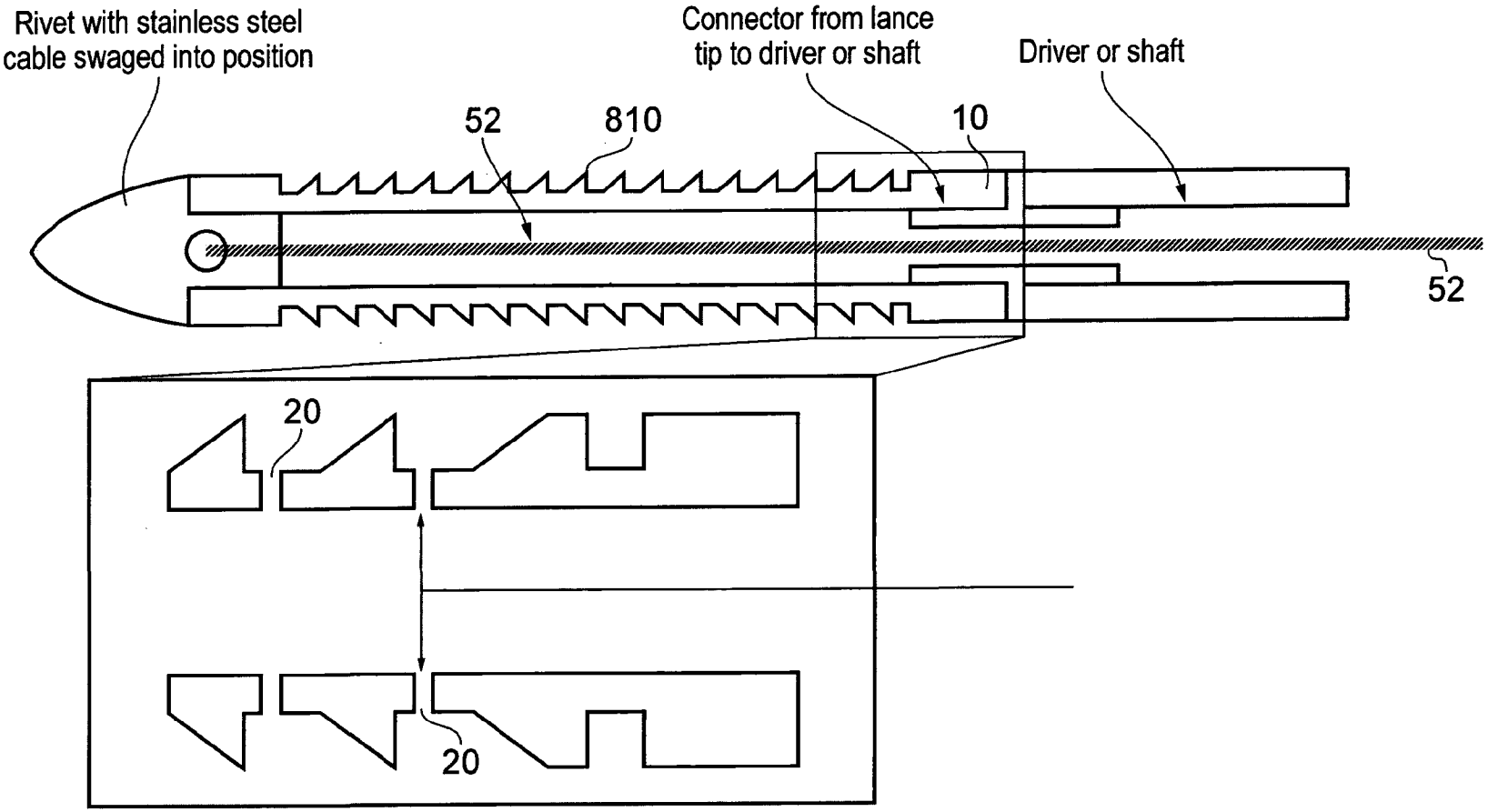
FIG. 8 shows a cross section of a delivery channel for use in loose ground with a tip mounted cable.
Figure 9:
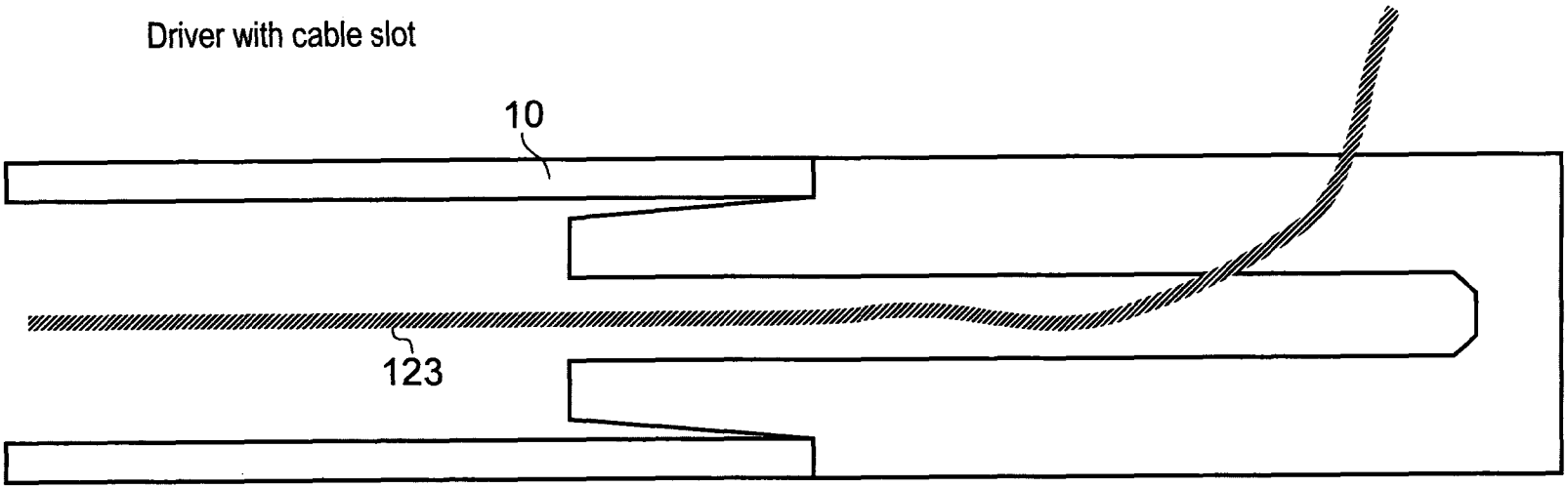
FIG. 9 shows a cross section of the deliver channel as shown in FIG. 8 with a cable slot.

FIGS. 7B, 8 and 9 reveal a system for soil consolidation adapted for use in loose ground 60. FIG. 7B shows a delivery channel 10 inserted into the ground 60, behind retaining wall 55. Referring to FIG. 7B, a distal conglomerate 805 is formed by injection of grout or resinous material 99 into the delivery channel 10 and selectively exuded at the distal tip 50 so as to function as an anchor 206 connected to plate 57, against wall 55, by way of tether 52. Auxiliary delivery systems P and Q are located adjacent to anchor 206 so as to create an arrangement of three adjacent anchors 206, 208 and 210. Another example of the anchoring system is shown in detail in FIG. 14).

FIG. 8 reveals a delivery channel 10, suitable as part of a ground anchoring system, with a textured outer wall 810, typically between 500 mm and 1000 mm in length, with a plurality of ribs 820. Apertures 20 provided between the ribs 820 so as to ensure grout fills the spaces between the ribs 820 and allows formation of a strong bond between the solidifying agent and the delivery channel 10.

The distal tip 50 houses a stainless steel cable 52 that runs from the distal tip 50 to beyond the proximal end of the delivery channel 10. The cable, ideally swaged into place in distil end 50, provides a tether on to which an object, such as a load spreading plate 55 against a wall 57 (FIGS. 7A and 7B) can be secured. Alternatively the tethering system can be used so as to fix an object, such as a structure, platform or buoy (not shown) to the sea bed.

FIG. 8 also reveals a driver 850 for aiding to drive the delivery channel into the ground 60. The driver 850 is dimensioned to be received concentrically within the proximate end of the delivery channel 10. The driver 850 has a central hole for receiving the cable 850 as shown in FIG. 9. The driver 850 extends from the proximate end of the delivery channel 10 enabling the delivery channel 10 to be more readily driven underground wherein none of the delivery channel 10 may be visible above ground.

FIG. 9 is a diagrammatic view of an anchor or end bearing for use with the aforementioned delivery channel and system. The anchor 200 or end bearing includes a cable 123 and end plug 124 which are located at a distal end of a delivery channel 10 when embedded in soil as described above. The anchor 200 or end bearing is typically incorporated as part of an anchoring system as shown in FIGS. 7A and 7B.

FIG. 10 is a detailed schematic cross section of the delivery channel 10 (shown in FIGS. 4 to 6) and illustrates how the grout or resinous material disperses into non-cohesive.

Pumping is performed at a relatively low pressure, as typically 5 m height of soil is approximately the same as 1 Bar.

Figures 11A, 11B:
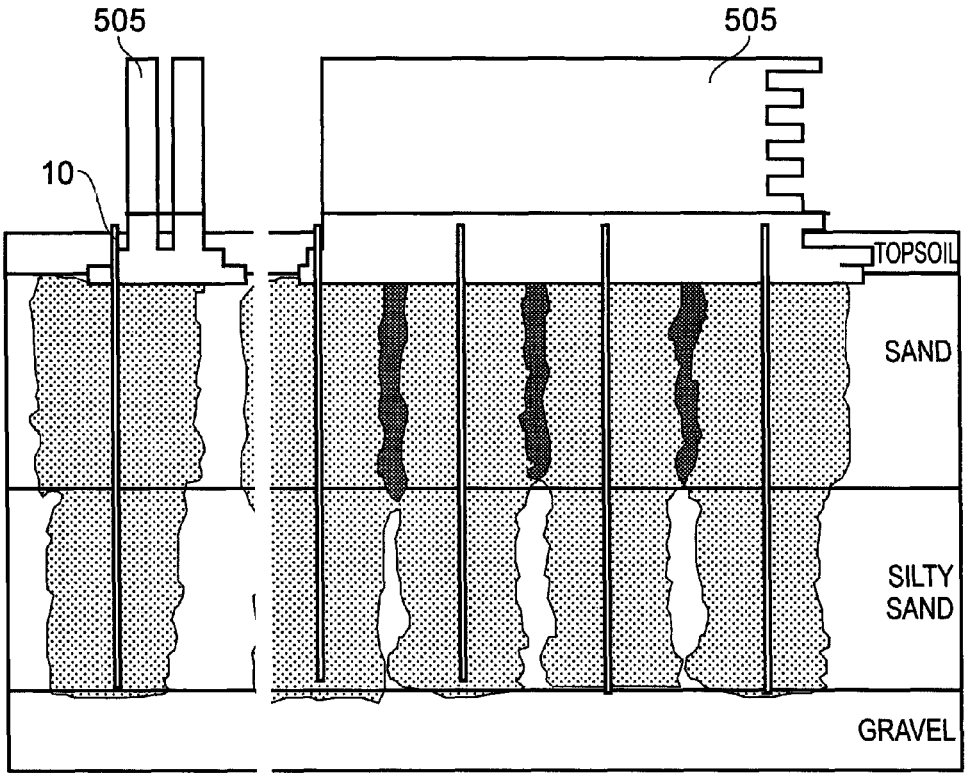
FIGS. 11A, 11B and 11C are a diagrammatic sectional view and corresponding plan views illustrating the soil consolidation system in a corbelled brick foundation.
Figure 11C:
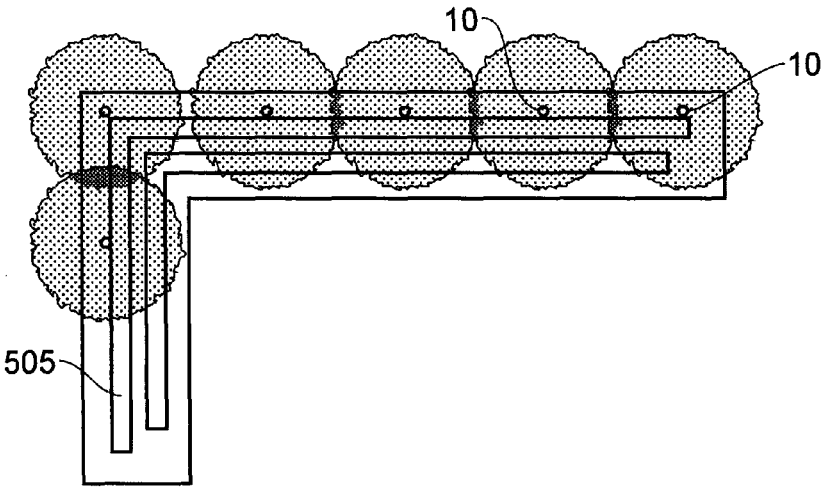
Figures 12A, 12B:
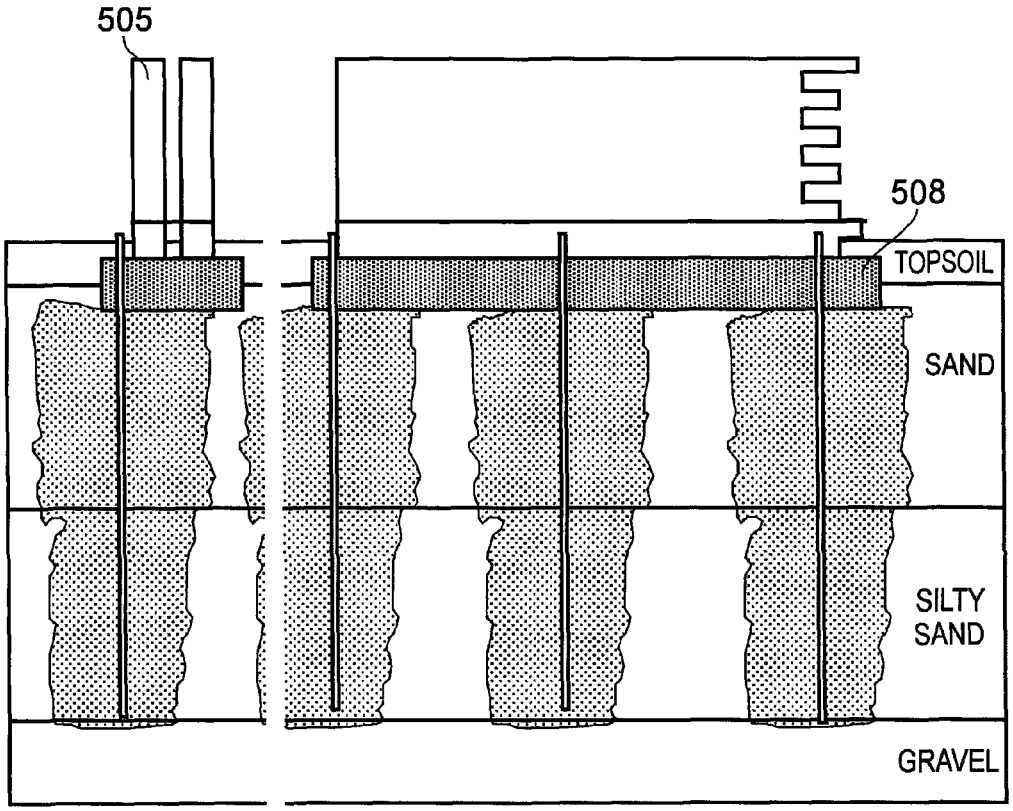
FIGS. 12A, 12B and 12C are a diagrammatic sectional view and corresponding plans view illustrating the soil consolidation system in permeable ground.
Figure 12C:
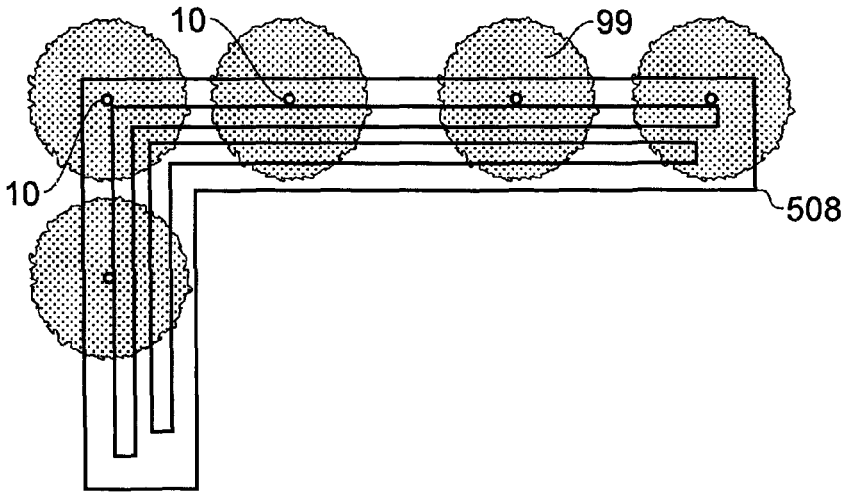
Figures 13A, 13B:
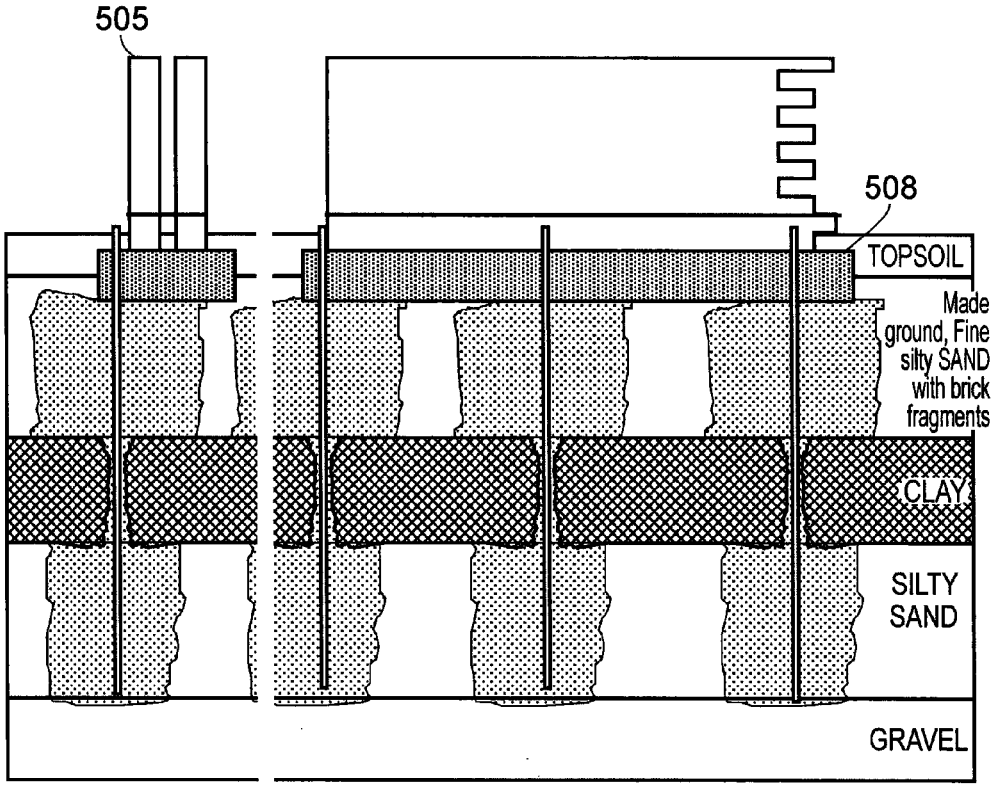
FIGS. 13A, 13B and 13C are a diagrammatic sectional view and corresponding plan views illustrating the soil consolidation system in permeable ground with clay.
Figure 13C:
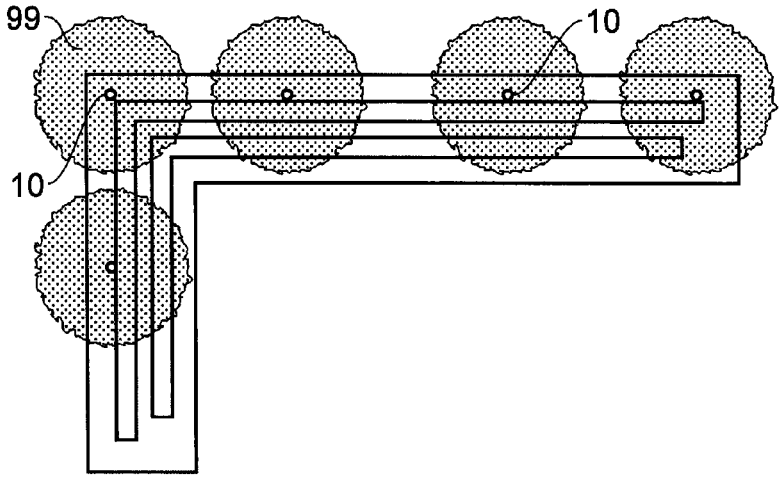

FIGS. 11, 12 and 13 show diagrammatic views illustrating soil consolidation systems in a corbelled brick foundation; permeable ground; and in permeable ground with clay. It will be appreciated that the invention may be placed in a prior drilled hole or it may be driven directly.

FIG. 11 shows end, side elevation and plan views of the system in use in a shallow corbelled brick foundations in cavity walls by forming a continuous foundation under an entire cavity walled structure. This is achievable as the delivery channels can be located so close to the external wall 505.

FIG. 12 shows end, side elevation and plan views of the system in use in an environment in which the soil is fully permeable. As can be seen the agglomerated mass of cured grout or liquid resinous material 99 forms into columns to the underside of the foundation 508. These piles tend to form cylindrically with a fairly constant diameter from between 200 mm to 500 mm and in a slightly tapered form.

FIG. 13 shows end, side elevation and plan views of the system in use in an environment in which the soil is layered with clay. As can be seen, the agglomerated mass of cured grout or liquid resinous material 99 forms into lobes or lenses in the permeable soil and narrows in the region of clay and less porous soil. However, as the delivery channel 10 bonds to the agglomerated mass of cured grout or liquid resinous material 99 the piles that are so formed maintain substantial weight bearing properties, as can be seen from the Tables below.

Figure 14:
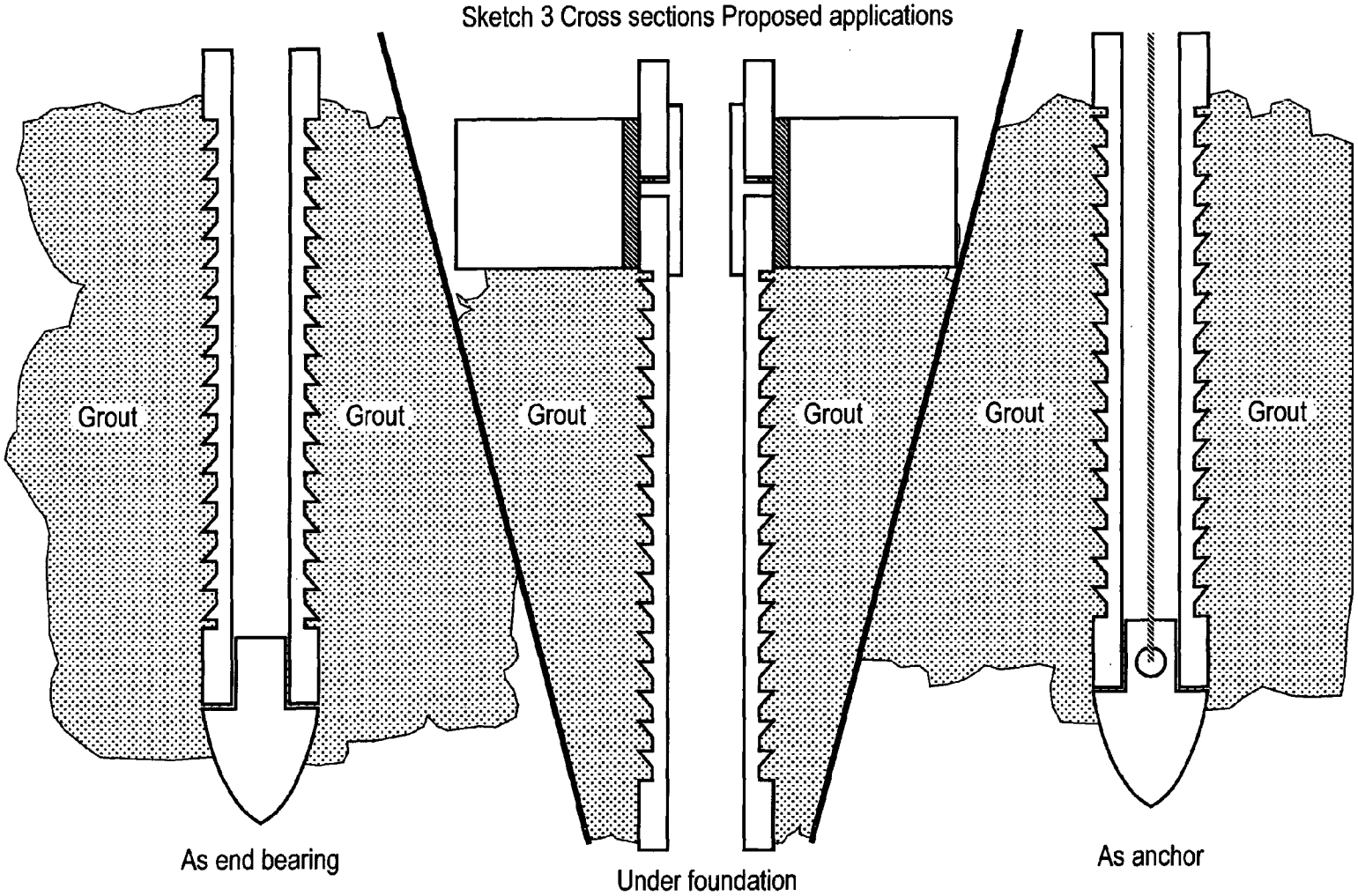
FIG. 14 is a diagrammatic sectional view illustrating an anchoring system for use in situations shown, for example in FIG. 7B.

Referring briefly to FIG. 14, which shows diagrammatically a sectional view illustrating an anchoring system, for use in situations depicted for example in FIGS. 7A and 7B. Anchoring is achieved for example by employing a tethered arrangement, as shown in FIG. 8, of the distal tip 50 by tethering it to an internal cable 52 which facilitates an anchorage within a permeation grouted mass 99 as shown for example in overall view in FIG. 7B.

The invention has been described by way of examples only and it is appreciated that variation may be made to the aforementioned examples without departing from the scope of the invention. For example, reference to a cylindrical channel is intended to include a channel with a different cross section, such as a square or other hollow section. Optionally a heater may be provided to warm the grout or resinous material and/or the delivery channel, so as to make the less viscous. This is particularly useful when applying the grout in colder conditions. Optionally pre-heated delivery channels may be driven into the ground.

Tables 1, 2 and 3 show test results of samples subjected to various test and illustrate the effectiveness of the system.

Table 1 shows test results from multiple samples of soil permeation grouted with geotechnical grade polyurethane resin. Table 1 is in 3 sections. The first section tabulates sample made in 100 mm×100 mm cube moulds, the second section shows results from larger 150×150 mm cube moults and the third section shows results from 102 mm cores made from actual permeation grouted ground. The samples were made to validate the design assumptions allowed when using the composite permeation piles for underpinning.

Table 2 shows results indicting that the delivery channel is capable of acting as a true structural element and, in combination with the agglomerated permeation grouted mass, the protruding (steel) delivery channel can be used to carry substantial compressive loads.

Changes to the end profile of the delivery channel may be made to enhance friction with the agglomerated permeation grouted mass. Loads were applied to short sections (500 mm) to assess safe loads. Failure of the composite pile did not occur in the tests, as the load carrying capacity of the soil was exceeded for piles of 1 m length. Those piles exceeding 3 m in length were loaded to approximately 16 tonnes without distress.

Table 3 shows the piles are intended to act as a composite of the agglomerated permeation grouted mass and the delivery channel, which is designed to have effective structural strength. Adhesion tests were carried out to assess the point of sheer failure between 33 mm delivery channels and geotechnical grade polyurethane, permeation grouted masses. Exceptional adhesion was noted with loads of approximately 7 tonnes per meter length of plain delivery channel required to induce failure.

Figure 15:
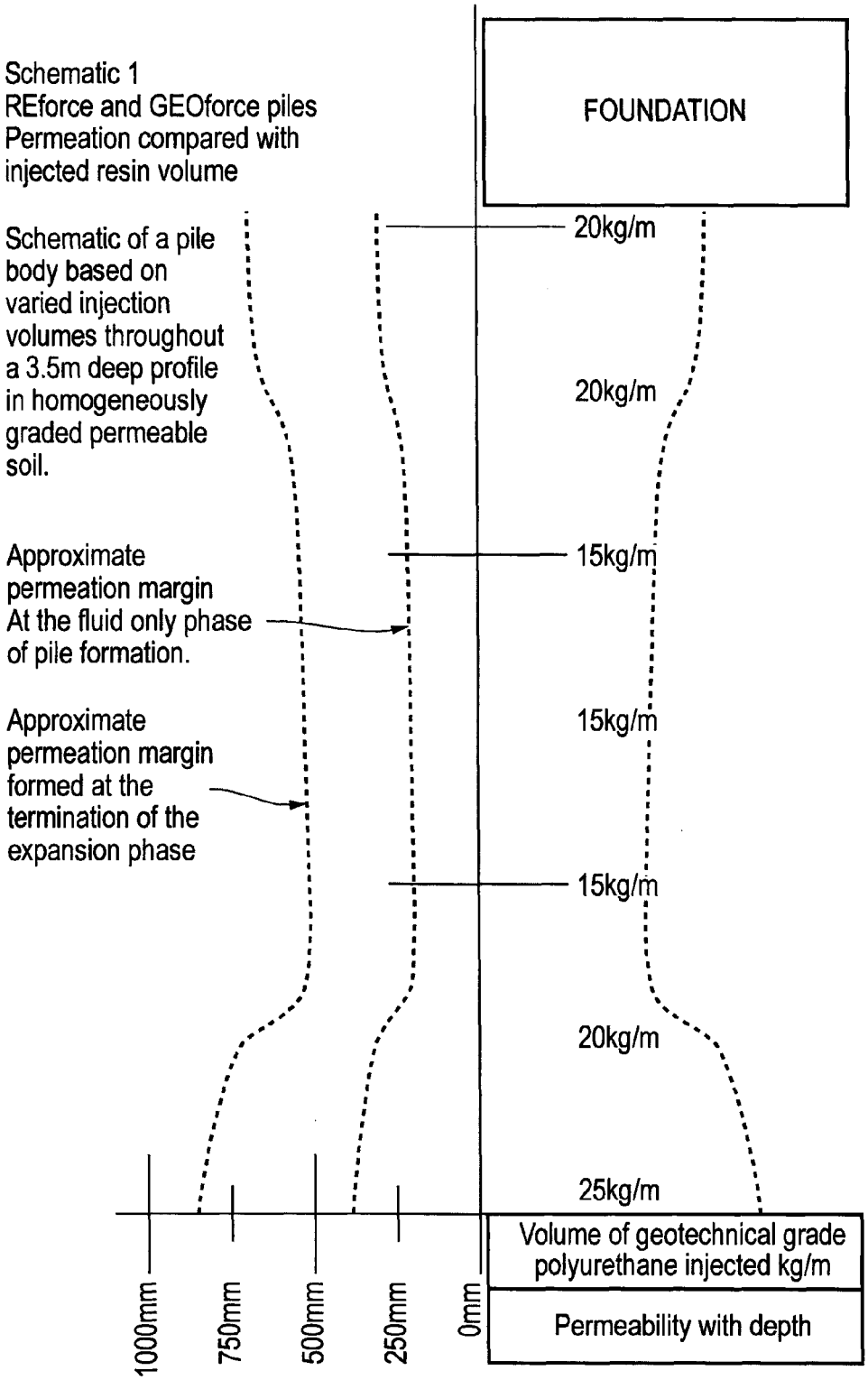
FIG. 15 is a schematic diagram illustrating results of soil permeation tests carried out to determine the likely size of piles formed using the invention.
Figure 16:
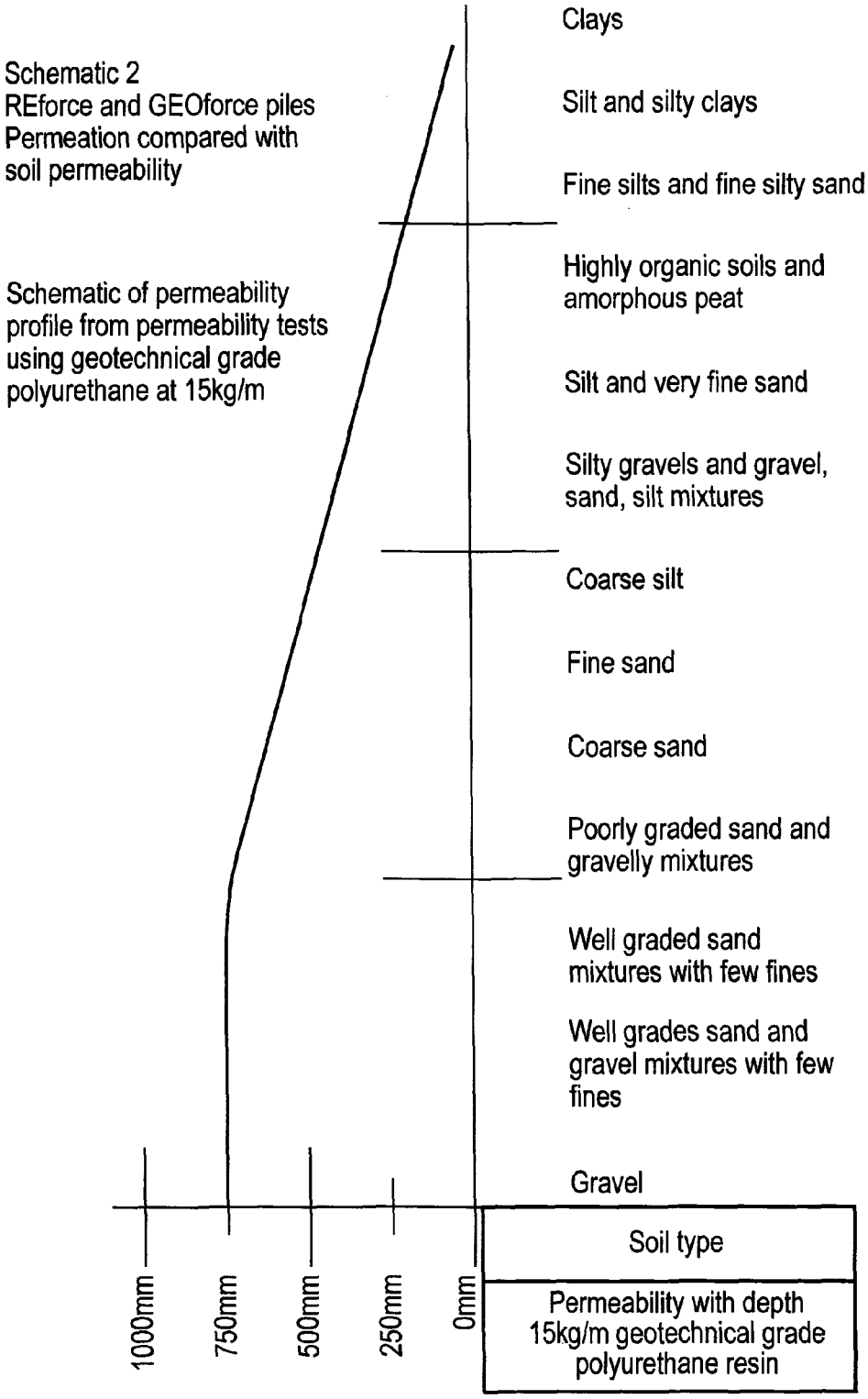
FIG. 16 is a schematic diagram showing the influence of soil type plotted against a standard placed quantity of geotechnical grade resin.

FIG. 15 shows results of soil permeation tests that were carried out to determine the likely size of piles formed. The shape of the pile can be influenced by the amount of grout or resin placed at any given level. Ground pressure (that is the force applied by the mass of soil acting downwards) is also influential being greater with depth.

Schematic 2 is derived from permeation tests and illustrates how the influence of soil type can be plotted against a standard placed quantity of geotechnical grade resin.

Suitable coatings or surface finishing may be applied on the delivery channel to adhere to the grout or resinous material thereby enhancing the bond between the delivery channel and the grout or resinous material.

With respect to the above description then, it is to be realised that the optimum dimensional relationships for the parts of the invention, to include variations in size, materials, shape, form, function and manner of operation, assembly and use, are deemed readily apparent to the person skilled in the art.

TABLE 1

Strength tests using 100 × 100 mm test cubes (Average values) N/mm$^2$

| | Sand | Gravel | Mixed loam soil |
|---|---|---|---|
| 1 day | 5.68 | 1.76 | 1.92 |
| 7 days | 7.27 | 2.88 | 3.54 |

Strength tests using 150 × 150 mm test cubes (average values) N/mm$^2$

| | Fine sand | Coarse sand | Coarse gravel | Well graded gravel | Poorly graded gravel | Sand and silt | Silt |
|---|---|---|---|---|---|---|---|
| 7 day | 5.8 | 8.4 | 4.1 | 5.0 | 4.4 | 5.1 | 2.8 |

Strength testing derived from sample cut from formed soil

| | Fine sand | Mixed fine sand & Loam | Coarse sand | Silty sandy gravel | Gravel |
|---|---|---|---|---|---|
| >7 days | 9 | 6 | 9 | 7 | void |

Load Tests on In-Situ Piles to Assess the Effectiveness of High Friction Devices Formed in the Delivery Channel to Enhance Capacity Beyond Adhesive Failure

TABLE 2

Load Tests on delivery channels with high friction end section 500 mm long

| Test No. | Test lance length | Mode | Load |
|---|---|---|---|
| 1 | 1.0 m | Soil compression | 81 kN |
| 2 | 1.0 m | Soil compression | 100 kN |
| 3 | 1.0 m | Soil compression | 88 kN |
| 4 | 1.0 m | Soil compression | 90 kN |
| 5 | 1.0 m | Soil compression | 86 kN |
| 6 | 1.0 m | Soil compression | 85 kN |
| 7 | 1.0 m | Soil compression | 82 kN |
| 8 | 1.0 m | Soil compression | 89 kN |
| 9 | 1.0 m | Soil compression | 78 kN |
| 10 | 1.0 m | Soil compression | 86 kN |
| 11 | 3.0 m | Not failed | >165 kN |
| 12 | 3.0 m | Not failed | >165 kN |
| 13 | 3.0 m | Not failed | >165 kN |

Assessment of Bond Between the Delivery Channel and Formed Pile

TABLE 3

| Lance to injected mass adhesion tests | | | |
|---|---|---|---|
| Test No. | Sample length | Failure load | Failure kN/m |
| 1 | 380 mm | 2800 kg | 72.21 |
| 2 | 360 m | 27000 kg | 73.61 |
| 3 | 430 mm | 3200 kg | 72.98 |
| 4 | 410 mm | 3440 kg | 82.27 |

The invention claimed is:

1. A ground stabilization system, suitable for soil consolidation, includes:

a delivery channel that is closed at one end and adapted to receive a grout or resinous material, the delivery channel having at least one chamber, there being at least one valve defining the at least one chamber and apertures formed in the delivery channel wall;

wherein the delivery channel is adapted to receive a concentric member, which in use passes through the at least one valve, the concentric member being displaceable with respect to the delivery channel such that the at least one valve is selectively opened and closed to permit at least one of grout and resinous material to fill a selected one of said at least one chamber and exude via the selected apertures, into regions of surrounding soil to create a stabilized volume of soil bonded to the delivery channel; and wherein the at least one valve is configured such that removal of the concentric member from the at least one valve acts to close the at least one valve, thereby sealing the at least one chamber.

2. The system as claimed in claim 1 wherein the concentric member is a hose or duct.

3. The system as claimed in claim 1 wherein non-return valves are defined in the delivery channel by way of a narrowing annulus.

4. The system as claimed in claim 3 wherein the narrowing annulus is held in position in the delivery channel by a connector which passes through the wall of the delivery channel.

5. The system as claimed in claim 1, further comprising:

means for pressurizing the at least one of grout and resinous material in the delivery channel.

6. The system as claimed in claim 1 wherein the channel includes an integral tip at the distal end.

7. The system as claimed in claim 6 wherein the distal tip is formed from one of case hardened steel and tungsten carbide.

8. The system as claimed in claim 6 wherein the distal tip is tethered to an internal cable.

9. The system as claimed in claim 1 wherein a diameter of the apertures formed in the delivery channel wall are in a range of 0.003 m to 0.01 m.

10. The system as claimed in claim 1 wherein the diameter of the delivery channel is in the range of 0.01 m to 0.1 m.

11. The system as claimed in claim 1 wherein the delivery channel is formed from a plurality of inter-engaging sections.

12. The system as claimed in claim 11 wherein the inter-engaging sections are joined by way of threaded end sections.

13. The system according to claim 1 wherein the apertures are tapered and/or rifled to limit clogging.

14. The system according to claim 1 wherein the delivery channel is adapted to accept an end cap.

15. A method for soil consolidation comprising the steps of:

driving a delivery channel into ground to be consolidated, the delivery channel being closed at one end and adapted to receive at least one of grout and resinous material, and having at least one internal valve that separates one chamber from an adjacent chamber;

filling the delivery channel with the at least one of grout and resinous material via a displaceable concentric member; and withdrawing the displaceable concentric member to allow the at least one of grout and resinous material to enter a cavity so that the at least one of grout and resinous material exudes via a selected aperture from the delivery channel into selected regions of surrounding soil, so as to form an agglomerated mass of soil and grout or resinous material which adheres to the delivery channel.

16. The method for soil consolidation as claimed in claim 15 comprising the steps of:

controlling egression of the at least one of grout and resinous material selectively from a chamber defined in the delivery channel into selected regions of surrounding soil.

* * * * *